US009092929B2

(12) United States Patent
White

(10) Patent No.: US 9,092,929 B2
(45) Date of Patent: Jul. 28, 2015

(54) METHOD AND APPARATUS FOR A PROGRESSIVELY DEVELOPED ARRAY GAME

(75) Inventor: Michael L. White, Glenview, IL (US)

(73) Assignee: Primo Innovo, LLC, Glenview, IL (US)

( * ) Notice: Subject to any disclaimer, the term of this patent is extended or adjusted under 35 U.S.C. 154(b) by 1893 days.

(21) Appl. No.: 11/823,387

(22) Filed: Jun. 27, 2007

(65) Prior Publication Data

US 2009/0005145 A1 Jan. 1, 2009

(51) Int. Cl.
*A63F 9/24* (2006.01)
*G07F 17/32* (2006.01)

(52) U.S. Cl.
CPC ..... *G07F 17/32* (2013.01); *G07F 17/3244* (2013.01); *G07F 17/3258* (2013.01); *G07F 17/3262* (2013.01); *G07F 17/3267* (2013.01); *G07F 17/3293* (2013.01)

(58) Field of Classification Search
CPC . G07F 17/32; G07F 17/3244; G07F 17/3258; G07F 17/326; G07F 17/3262; G07F 17/3267; G07F 17/34
USPC ..... 463/16, 21
See application file for complete search history.

(56) References Cited

U.S. PATENT DOCUMENTS 5,584,764 A 12/1996 Inoue
5,609,524 A * 3/1997 Inoue ..... 463/20
5,704,835 A 1/1998 Dietz
5,971,849 A * 10/1999 Falciglia ..... 463/16
6,123,333 A * 9/2000 McGinnis et al. ..... 273/146
6,220,959 B1 4/2001 Holmes
6,322,445 B1 11/2001 Miller
6,443,456 B1 9/2002 Gajor
6,855,054 B2 * 2/2005 White et al. ..... 463/21
6,976,917 B2 12/2005 Peccole
7,001,274 B2 2/2006 Baerlocher
7,007,953 B1 3/2006 Cabot
7,137,628 B2 11/2006 Moody
7,137,883 B1 * 11/2006 Falciglia, Sr. ..... 463/13
7,850,515 B2 * 12/2010 Dussault ..... 463/13
8,366,535 B2 * 2/2013 Watkins et al. ..... 463/20
8,425,303 B2 * 4/2013 Kennedy et al. ..... 463/20
8,512,138 B2 * 8/2013 Saunders ..... 463/31
2001/0034618 A1 * 10/2001 Kessler et al. ..... 705/4
2002/0193160 A1 * 12/2002 Tarantino ..... 463/20
2003/0092480 A1 * 5/2003 White et al. ..... 463/20
2005/0148381 A1 7/2005 Marks
2005/0159199 A1 7/2005 Moody
2005/0250578 A1 * 11/2005 Slomiany et al. ..... 463/20
2006/0157936 A1 7/2006 Moody
2007/0082721 A1 * 4/2007 Groves ..... 463/12

* cited by examiner

*Primary Examiner* — Lawrence Galka
(74) *Attorney, Agent, or Firm* — Michael L. White

(57) ABSTRACT

A wagering game that forms an array of indicia that contains multiple individual games that are played serially. The game array is built by a series of primary games. Primary games are those games that are played serially—the game outcome for one primary game is determined before the subsequent primary game begins. Secondary games are progressively formed through the sequential completion of the primary games—the secondary games are formed from indicia contributed by a plurality of primary games.

3 Claims, 18 Drawing Sheets

PAY TABLE

5-CARD POKER

400

| 410 CARD HAND | 420 PAYS |
|---|---|
| ROYAL FLUSH | 50 |
| STRAIGHT FLUSH | 10 |
| FOUR OF A KIND | 7 |
| FULL HOUSE | 5 |
| FLUSH | 4 |
| STRAIGHT | 3 |
| THREE OF A KIND | 2 |
| PAIR | 1 |

*FIG. 4*

PAY TABLE

3-CARD POKER

500

| 510 CARD HAND | PAYS 520 |
|---|---|
| ROYAL FLUSH | 10 |
| STRAIGHT FLUSH | 5 |
| THREE OF A KIND | 4 |
| STRAIGHT | 3 |
| FLUSH | 2 |
| PAIR | 1 |

*FIG. 5*

METHOD AND APPARATUS FOR A PROGRESSIVELY DEVELOPED ARRAY GAME

FIELD OF THE INVENTION

This invention relates to gaming, and more particularly, in one embodiment to wagering games played on gaming machines such as video poker and slot-type gaming machines.

BACKGROUND OF THE INVENTION

Gaming machines are an extremely popular form of entertainment with gaming establishment patrons. At one time, table games provided the bulk of gaming revenues for gaming establishments. Now, however, gaming machines have become so popular with the public that, in some gaming establishments, revenues from gaming machines surpasses table games.

SUMMARY OF THE INVENTION

A method and apparatus for a wagering game are described that allows a player to progressively build an array of indicia containing a plurality of game outcomes. This wagering game may be implemented on an electromechanical or video type gaming machine. The array is progressively developed through the serial determination of a plurality of primary game outcomes. Each primary game outcome is defined, in one embodiment, by a plurality of indicia assigned to predetermined array positions that define that primary game. In another embodiment, each array position in the array at least partially defines only one primary game outcome.

Secondary games are progressively formed by the primary game outcomes as the primary game outcomes are serially determined. Secondary game outcomes are defined, in one embodiment, by indicia from a plurality of primary game outcomes in predetermined array positions.

For example, in one embodiment, the array may be a rectangular array composed of rows and columns wherein each row may define a primary game outcome, and each column may define a secondary game outcome. As each primary game outcome is serially completed, the secondary game outcomes defined by the columns of the array are progressively developed. When the last primary game outcome is completed (e.g., filling the last row of the array), each of the secondary game outcomes in each column of the array is completed.

The objective of the game, in one embodiment, is to form winning primary and secondary game outcomes in the array. In some embodiments, this objective is facilitated with the implementation of selectable modification operations that may improve, or potentially improve, the probability of obtaining a primary and/or secondary winning game outcome. This presents the player with the strategic challenge of building future winning secondary games while attempting to win each of the primary games in the series as each is presented.

BRIEF DESCRIPTION OF THE FIGURES

Various embodiments of the array game are described and illustrated by the accompanying figures. The figures are provided as examples only and are not intended to be considered as limitations to the invention. Similarly, numerical entries only represent exemplary information, and those skilled in the art understand that a variety of different values and alternate arrangements can be made. Consequently, the array game is illustrated by way of example and not by limitation in the accompanying figures in which:

FIG. 4 illustrates an exemplary five-card poker pay table used in conjunction with one embodiment of the array game;

FIG. 5 illustrates an exemplary three-card poker pay table used in conjunction with one embodiment of the array game;

DETAILED DESCRIPTION

Figure 1:
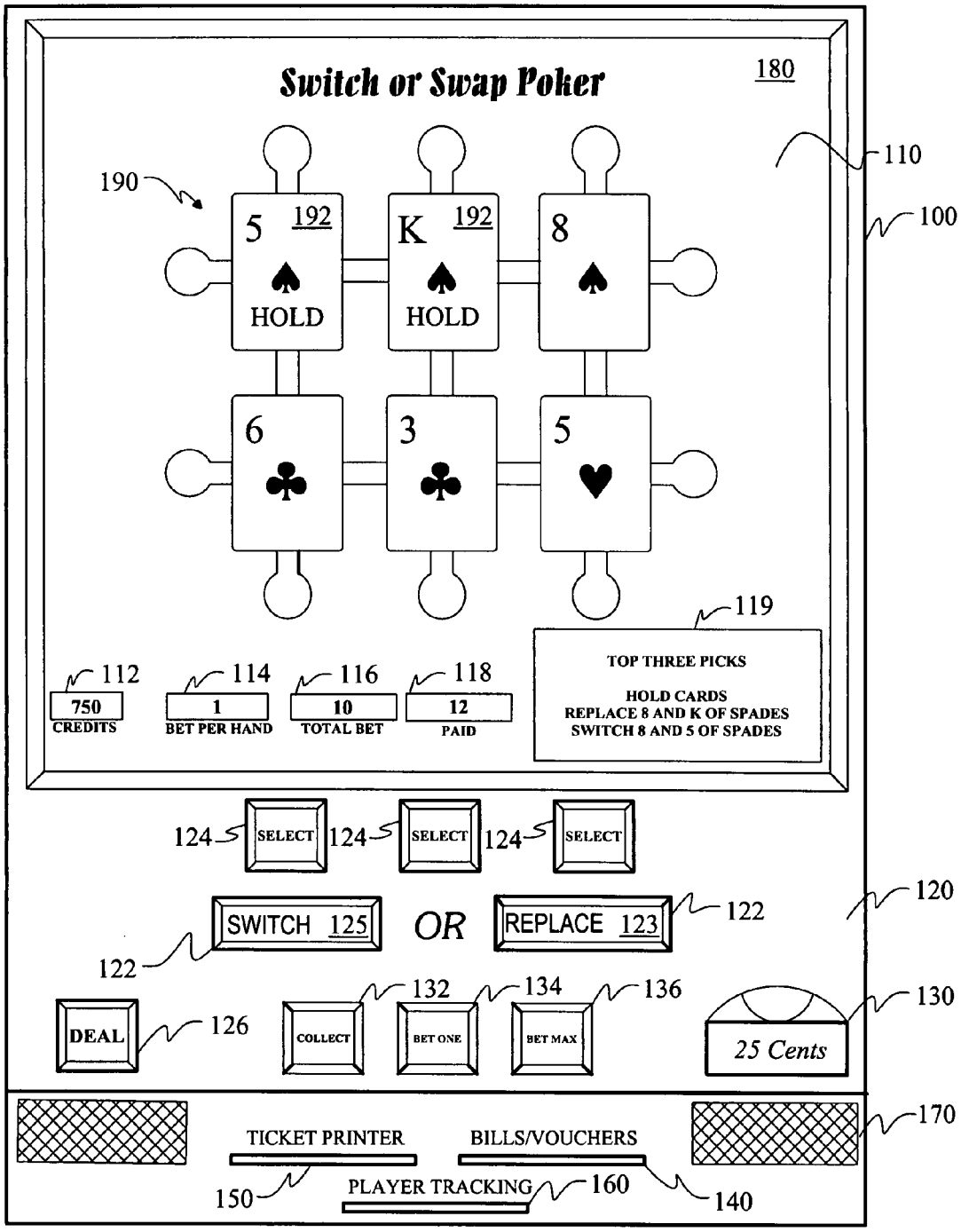
FIG. 1 is an orthogonal view of one embodiment of an exemplary video gaming machine.

The wagering game method described in the following embodiments may be adapted for play on gaming machines similar to those commonly found in gaming establishments.

Gaming machines may be categorized into two types: electromechanical slot-type gaming machines and electronic video gaming machines.

Electro-mechanical slot-type games have mechanical reels driven by electric stepper motors. The mechanical reels are spun and stopped by the electric stepper motors in a predetermined orientation to produce a game outcome. One type of electromechanical slot machine has a single pay line and three independent, mechanical reels that display three randomly selected indicia on the pay line.

Another type of electro-mechanical slot machine uses multiple independent reels—each reel for displaying a single indicium—to produce an array of indicia having a plurality of rows and columns. This multiple independent reel version of the electromechanical slot-type gaming machine is described in several patents including U.S. Pat. No. 5,584,764, "Slot Machine" to Inoue which is hereby incorporated by reference in its entirety. This type of electro-mechanical gaming machine is particularly well-suited for displaying a game array and selectively altering indicia in selected array positions. The independent control of each of the multiple reels inherent in this type of electro-mechanical gaming machine facilitates the progressive development and manipulation of the game array in accordance with this novel wagering game.

In contrast to the electromechanical gaming machine, the electronic video gaming machine has a video display—rather than mechanical reels—to display a game outcome. This difference in display methodologies is one of the most significant visible difference between electromechanical gaming machines and their electronic video gaming machines counterparts. All other major gaming machine functions are similar for both electromechanical and video gaming machines as they are both controlled electronically by a CPU which executes a game program.

A video type gaming machine, because of its video display, is highly adaptable to most wagering games and is capable of offering a variety of games and optional game enhancements that are more difficult to provide, in some embodiments, on an electromechanical type gaming machine. Because of their flexibility, electronic video gaming machines are used not only for slot-type games, but also for card games. These card games include Poker, Blackjack, and other traditional and non-traditional card games.

Gaming Machine Description

In some embodiments, the gaming machines on the floor of a gaming establishment are in communication with a number of servers (usually located within the gaming establishment) that provide ancillary support services for wagering activity at each gaming machine. These servers, and the gaming machines they serve, are connected in a communications network that forms a gaming system. In one embodiment, typical servers commonly found in a gaming system include: an accounting server to record wagers and payouts, a player-tracking server to track wagering activity of individual players, and a cashless gaming server to issue and redeem wagering vouchers. In this embodiment, the gaming machine determines the game outcome and the servers support the wagering and data collection activities of each gaming machine in the gaming system.

The gaming machines and their associated servers typically use serial communication protocols for transferring data over the gaming system communication network. In other embodiments, these gaming systems may use Ethernet type communication protocols—or any other communication protocol using any number of different types of communication media (including, e.g., optical fiber, radiofrequency, etc).

In other embodiments, in lieu of executing a game program on a CPU located in the gaming machine, the execution of the game program is performed by a CPU in a central game server that is part of the gaming system. For example, in one embodiment, the central game server may execute a game program in response to initiation of the wagering game at a gaming machine. The central game server communicates game play data to the gaming machine for display on the gaming machine's video display. In this embodiment, the game server may perform all calculations and simply transfer video data for display on the gaming machine. Player selections may be communicated from the gaming machine to the gaming server for further execution of the game program by the central gaming server.

Alternatively, a CPU in the gaming machine and a CPU in a central game server may each execute portions of a game program. For example, the game server may be limited to determining and transmitting random numbers to the gaming machine, which in turn may be used to determine, either directly or indirectly, game outcomes. For example, the gaming machine may use the random number to select appropriate video images that display a game outcome corresponding to the random number received from the central game server. Alternatively, the random number received from the central game server may be used as a seed in a random number generator driven by the gaming machine CPU to determine a game outcome.

The operation of an exemplary video-type gaming machine in the context of wagering activity is described below. As noted above, except for the display of game outcomes, the operating principles of electromechanical gaming machine and video gaming machine are basically similar.

With reference to FIG. 1, one embodiment of an exemplary video type gaming machine 100 is illustrated. The gaming machine 100 has a wager acceptor for initiating game play. The wager acceptor may be a bill validator 140 (which accepts paper currency), a coin acceptor 130, or any other device capable of receiving and registering some form of acceptable monetary value. The bill validator 140 may, in some embodiments, also accept vouchers (generally in the form of paper tickets).

Vouchers are printed by some gaming machines 100 in lieu of paying coins when a player cashes out of the gaming machine. The gaming machine 100, in this embodiment, typically has a ticket printer 150 which prints a voucher for the value of the cash out from the gaming machine.

Each voucher has a unique barcode identifier associated with a specific monetary value. The barcode identifier is communicated to the cashless server in the gaming system. The cashless server stores this information for later recall when the voucher is presented for redemption. Typically, the voucher may be redeemed by a gaming machine 100 or by a cashier in the gaming establishment.

When redeemed by a gaming machine 100, in one embodiment, the voucher is inserted into the bill validator 140. The bill validator 140 reads the barcode printed on the voucher and communicates the barcode number to the cashless gaming server. The cashless gaming server, in turn, validates the voucher and communicates the value of the voucher back to the gaming machine 100. The value of the voucher is credited for play on the gaming machine 100.

The gaming machine 100, in some embodiments, may have an alternative or additional payout mechanism such as a coin hopper (not shown on FIG. 1) internal to the gaming machine. The coin hopper dispenses coins to the player when the player cashes out, and in some embodiments, for individual winning game outcomes.

The gaming machine 100 may also include a card reader 160 for reading an identification card commonly known as a player-tracking card. The player-tracking card is commonly provided to gaming patrons to participate in player loyalty programs sponsored by the gaming establishment. The player tracking card is encoded with a unique player identification number. The card reader 160 accepts the player-tracking card and communicates the player's identification number to a player-tracking server. The player-tracking server maintains a record of the player's wagering activity, allowing the gaming establishment to reward gaming patrons commensurate with their wagering activity.

Game play is initiated when the gaming machine 100 receives a wager. The array game 190, in one embodiment, is displayed on the video display 110 of the gaming machine 100. The video display 110 is generally a CRT or flat-panel display such as a LCD, LED, or plasma display. However, any other type of display may be used to present the array game 190. For example, in an electromechanical type gaming machine, the array game 190 may be displayed with mechanical reels.

The video display 110 may also have a video representation of meters to provide wagering information to the player. The meter display may include: a credit meter 112 (displays total credits available for wagering), bet per pay line meter 114 (displays the number of credits bet on each pay line), the current bet meter 116 (displays total wager amount on the game), and a paid credit meter 118 (displays payoff obtained from a winning game outcome).

The video display 110 may operate, in some embodiments, in conjunction with a touch screen 180. Icons representing various potential player selections may be presented on the video display 110. The player may touch the desired icon presented on the video display 110 to receive the corresponding function represented by the icon. The gaming machine 100 then implements the selection's function.

In addition to using a touch screen 180, the player may also make selections, in some embodiments, using a pushbutton panel 120. The pushbutton panel 120 may allow the player to make game play and wagering selections. For example, the player may designate: the amount wagered on each individual game (e.g., the bet one pushbutton 134 and the bet max pushbutton 136), the start of the game (e.g., the deal pushbutton 126), and the collection of the remaining credits on the gaming machine (e.g., using the collect pushbutton 132 when the player has finished wagering).

In addition to controlling wagering, the execution of the player's game play strategy may also be performed with the pushbutton panel 120. For example, in order to execute the player's game play decisions, in one embodiment, select pushbuttons 124 are used to allow the player to designate indicia 192 to which an operation may be applied (or in alternative embodiments, to designate specific indicia to which an operation is not applied).

For example, as shown in FIG. 1, the Five of Spades and King of Spades are designated indicia 192. This designation of indicia has been performed, in one embodiment, by first selecting an operation pushbutton 122. In this exemplary embodiment, there are two available modification operation pushbuttons 122: an interchange pushbutton 125 and a replacement pushbutton 123. In this example, the player has selected to replace indicia and consequently, the replacement pushbutton 123 has been selected. The player then selects the indicia to be held (designated indicia 192) using the corresponding select pushbuttons 124. The replacement modification operation is then performed by again selecting the replacement pushbutton 123 to confirm the desired selection.

Alternatively, the player could have selected the interchange pushbutton 125 to interchange indicia. In this case, the corresponding select pushbuttons 124 could again designate the Five of Spades and King of Spades to which the modification operation would apply. The Five of Spades and the King of Spades interchange array positions after the interchange pushbutton 125 is again selected to confirm the desired selection. The designated indicia 192, in one embodiment, may be designated for easy visibility with appropriate icons to assist the player. For example, the "SWITCH" symbol or the "HOLD" symbol may appear on designated indicia 192 selected by the select pushbutton 124 dependent on the modification operation selected.

It should be noted that the player interface for controlling the gaming machine 100 described above is but one embodiment of many possible designs. For example, in one embodiment, the modification operations and designated indicia could be selected directly through the touch screen 180 to implement game play strategies without the use of the push button panel 120.

In addition, the gaming machine 100 may provide sound effects or music to accompany game play. The speakers 170 may also provide game play information or help the player make strategic game play decisions.

A player, in some embodiments, may request help from the gaming machine to make game play decisions. The gaming machine 100 may provide the player with one or more potential game play strategies through a help screen 119 presented on the video display 110. These game play strategies may take the form of specific selections to modify the game array—applying specific predetermined operations to the game array. The help screen 119 is driven, in one embodiment, by player assistance software through the game program.

In one embodiment, in its most extreme form, the player assistance software may act as auto-play software that plays the game for the player (i.e., the auto-play software makes all game play strategy decisions—apart from actual wagering).

In another embodiment, the player assistance software provides a plurality of possible game play strategies. These game play strategies may be designed to obtain: 1) the maximum player return (balancing probability of occurrence with the payoff value); 2) the largest potential return to the player (i.e., largest payoff value regardless of the probability of the outcome); or 3) the greatest probability of producing winning game outcomes in the array. In this embodiment, the help screen may provide the best available selections for each of these game play strategies, allowing the player to select one of the three strategies for implementation.

Alternatively, in another embodiment, the help screen may only provide the best available game play strategies for maximizing return to the player. For example, the top three best available game play options may be provided to the player. In this embodiment, the player is not informed which of the three available strategies will produce the best return (i.e., there is no ranking of the strategies). Consequently, the player still must make a decision as to the relative merits of each of the strategies presented.

In another variation of this embodiment, the best available game play options may include all game plays that potentially produce a rate of return (i.e., a payback percentage) greater than a fixed amount. The player may or may not be provided with statistical information regarding the potential return associated with each of the possible game play options. For example, in one embodiment the help screen 119 only provides the player with a number of different game play options from which to select.

The help screen 119 speeds game play, in one embodiment, by making the player comfortable in the knowledge that the best possible game play selections (e.g., the top three best game play selections) are being provided by the help screen. Consequently, to some degree, making any selection from the help screen is a reasonably good selection—i.e., the player does not fear making a bad decision. In addition, in this embodiment, the help screen helps assure the player that a particularly good selection has not been overlooked—a potentially occurrence associated with particularly complex game arrays and games. This may save considerable game play time if the player is searching for a particularly good game play option that simply is not in the game array.

In this embodiment, because the help screen program provides a plurality of best available game play options, the player is still engaged with the game—making game play decisions. This is in sharp contrast with prior art programs that implement the best available game play option for the player—effectively playing the game for the player (sometimes known in the gaming industry as auto-play).

If desired, in one embodiment, the level of help provided by the help program software may correspond to different pay tables. For example, a tighter pay table (i.e., a lower expected value pay table) may be provided with a help program that provides only the best two available game play option than with a help program that provides the best three game play options. Taken a step further, for game play in which no help screen is provided, the pay table may be looser (i.e., a higher expected value) than with a game that provides a help screen. Consequently, the pay table associated with a game array is a function of the level of assistance provided to the player through the help screen.

Figure 2:
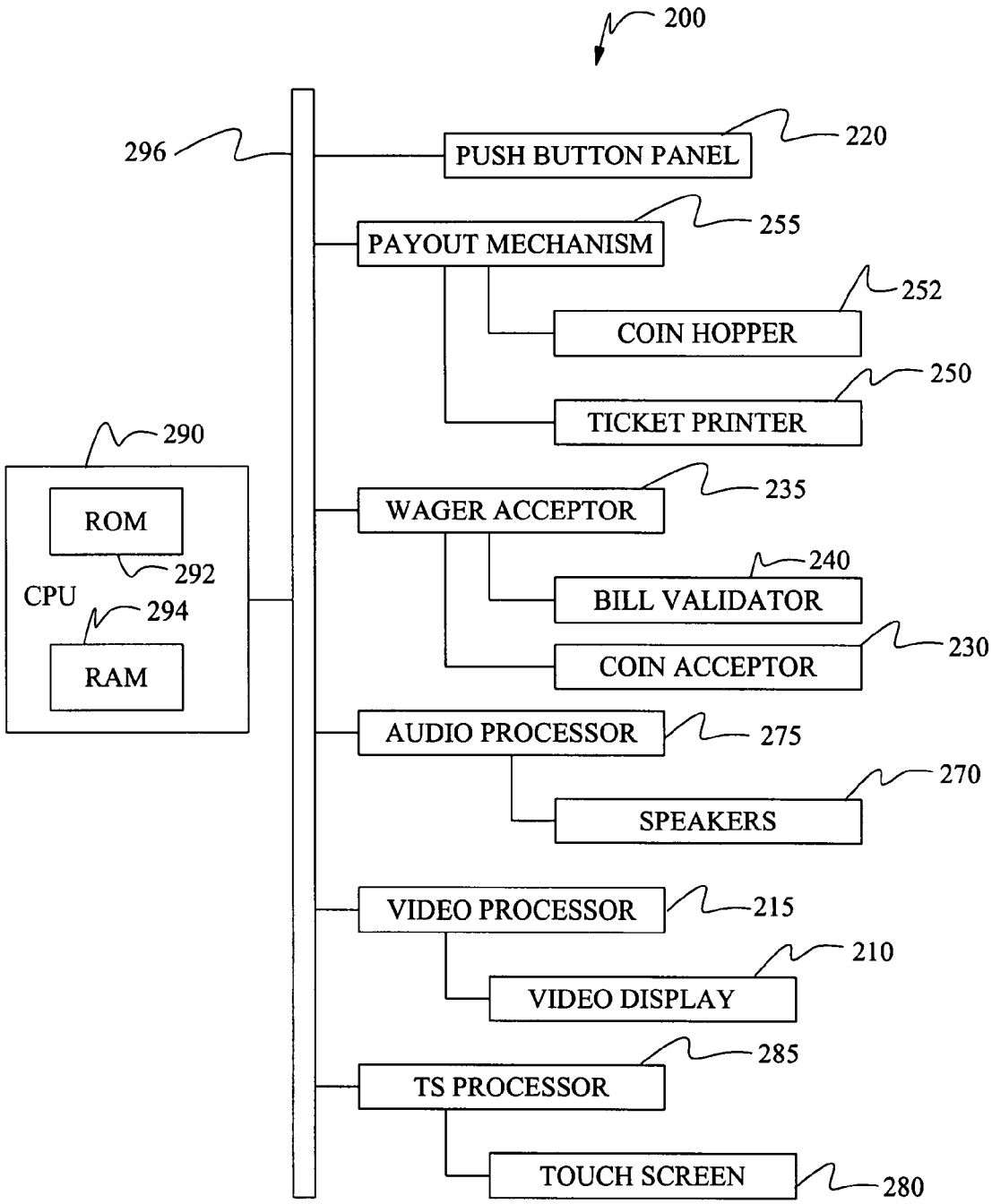
FIG. 2 is an exemplary block diagram of one embodiment of the control system of the video gaming machine of FIG. 1.

With reference to FIG. 2, an exemplary control block diagram 200 is provided depicting the operational control, in one embodiment, of the gaming machine 100 illustrated in FIG. 1. The CPU 290 controls the operation of peripheral devices ancillary to the operation of gaming machine 100 through the execution of the game program. Among the peripheral devices controlled, either directly or indirectly, by CPU 290 include: the bill validator 240 and coin acceptor 230 (more generally known as wager acceptors 235, the video display 210 (controlled by video processor 215), the pushbutton panel 220, the coin hopper 252 and ticket printer 250 (more generally known as payout mechanisms 255), speakers 270 (controlled by audio processor 275), and the touch screen 280 (controlled by touch screen processor 285).

In addition to controlling each of the gaming machine's peripheral devices, the CPU 290, through the execution of the game program, also controls game play. The CPU 290 has both non-volatile read-only memory (ROM) 292 in which the game program is stored and volatile random access memory (RAM) 294 in which the game program is executed.

The game outcome displayed by the typical gaming machine is determined by the central processing unit (i.e., CPU). In one embodiment, the CPU 290 determines a game outcome by first generating a random number with a random number generator (not shown). In one embodiment, the random number generator (RNG) employs a mathematical formula to determine a random number. The random number determined is within a predetermined numerical range and corresponds to a game outcome listed in a probability table stored in memory.

The probability table determines the probability of occurrence of any game outcome by associating each of the random numbers in a given range with a game outcome. The probability table is usually weighted to achieve a desired game outcome distribution over a large number of game outcomes. Consequently, some game outcomes will be associated with more random numbers than other game outcomes.

With the random number, the CPU 290 determines the corresponding game outcome, which is displayed by the gaming machine. The CPU 290 in a video gaming machine signals the video processor 215 to display the game outcome on the video display 210. In the case of an electromechanical gaming machine, the CPU 290 signals electric stepper motors to stop a plurality of mechanical reels in the orientation corresponding to the determined game outcome.

The CPU 290 has an I/O bus 296 to control communications between the CPU and each of the peripheral components. The CPU 290 typically not only controls and communicates with peripheral devices inside the gaming machine 100, but is also in communication with various servers that provide ancillary support services for the gaming establishment as previously discussed. Typically, the CPU 290 has a communication port (not shown) that provides a communication link between the gaming machine 100 and the servers in the gaming system through the communication network.

As noted previously, the gaming machine 100, in one embodiment, may be a part of a gaming system in which a gaming machine receives game outcomes from a central game server. In such an embodiment, the gaming machine 100 may be limited to the control of peripheral devices associated with the gaming machine and network communications with servers in the gaming system.

Finally, it should be noted, that although the array game can be executed as a wagering game, in another embodiment, it can also be played as a non-wagering game. For example, in one embodiment, the wagering game may be played on the gaming machine 100 illustrated in FIG. 1, as a bonus game supplementing a standard wagering game.

Bonus games are common in the gaming industry and are typically provided to players based on game outcomes received in a base wagering game. For example, a player may receive a combination of indicia in a base wagering game that shifts the gaming machine into a different game play mode (i.e., changes the type of the game offered the player). These bonus games typically do not require an additional wager to play above and beyond the wager placed to initiate play on the base wagering game. The bonus games typically offer the player the potential for winning additional credits. Once the bonus game has been completed, the gaming machine 100 returns the player to the base wagering game.

In another non-wagering game embodiment, game play may be executed on a gaming machine 100 similar to that of the gaming machine described above and illustrated in FIG. 1. Such a gaming machine 100 functions similarly to the control block diagram illustrated in FIG. 2 except that, in such a non-wagering embodiment, the gaming machine would not require a payout mechanism 255 or the wager acceptor 235.

Types of Games Available in the Game Array

One of the principal differences, in one embodiment, between traditional wagering games and the progressively developed game array is the development of the game array in stages—each stage marked by the completion of a primary game until all the primary games in the series are completed. This allows the player to make strategic choices that modify the game array as it is built—permitting the player to adapt changing strategies as the game array develops to increase the probability of a winning game outcome.

In general, any type of wagering or non-wagering game that requires the collection of specified indicia to form a winning game outcome may be adapted for play in the game array. In addition to the collection of specified indicia, the game may have further requirements for a winning game outcome including specified orientation and order in the game array.

For example, most card games can be implemented within the game array concept. These card games include, for example, and not all-inclusive, Poker, Blackjack, and their variants. Poker variants, for example, may be played as a three-card, five-card, or seven-card game.

Other embodiments are possible that use games other than card games in the game array. For example, the progressively developed game array can be extended to slot-type games that typically use single characteristic indicia (e.g., traditional slot-type symbols, such as cherries, plums, and oranges). Winning game outcomes may be determined using similar criteria as traditional slot-type games that require, for example: certain symbols (e.g., cherries), in a specified order (e.g., left to right), repeated a specified number of times (e.g., repeated at least twice). In some embodiments, winning symbol combinations may be required to occur in adjacent array positions rather than scattered in non-adjacent positions. The symbols themselves may represent different monetary values; one symbol paying more than another symbol based on the probability of that symbol appearing in the game array.

In the embodiments discussed above, different types of indicia may be used dependent upon the type of game implemented in the game array. For example, card games use multi-characteristic indicia (e.g., a playing card) from an indicia set (e.g., playing card deck) to determine game outcomes.

Multi-characteristic indicia have a plurality of inherent parameters which either separately or taken together, may determine a game outcome. For example, a playing card is a multi-characteristic indicium having both a rank and suit. The player may have a winning game outcome based on the rank, suit, or both the rank and suit.

Multi-characteristic indicia may be comprised of a single symbol or multiple symbols. For example, a card has both a rank and a suit (e.g., the two of Spades indicium has a symbol for the rank (i.e., the number two) and a symbol for the suit (i.e., Spade). In other embodiments, a multi-characteristic symbol may consist of a single symbol. For example, a single symbol (e.g., a red number two) may have both a color parameter (i.e., red) and a numeric parameter (i.e., two).

Single characteristic indicia have only one inherent parameter that can affect game outcome. Examples of single characteristic indicia include symbols used in some traditional slot-type gaming machines such as oranges, plums, and cherries. An example of an even more basic single characteristic indicia are a set of indicia formed from different colors (e.g., such as red, white, and blue indicia).

In another embodiment, letters may be used as single characteristic indicia. For example, in one embodiment the game array could be reminiscent of a crossword type puzzle, allowing the player to create words as the game array is progressively developed.

Game arrays may be formed, in some embodiments, with only multi-characteristic indicia, only single characteristic indicia, or both multi-characteristic and single characteristic indicia. Regardless of the type of indicia used, in some embodiments, the preliminary game outcomes in the game array are formed from these indicia.

In one embodiment, the indicia set is a plurality of indicia from which indicia may be selected randomly. In some embodiments, the indicia set may receive discarded indicia from the game array so that all of the original indicia in the indicia set are either in the game array or in the indicia set. In other embodiments, discarded indicia are not available for further selection in the game array. In other embodiments, the indicia set may be immediately replenished with the same indicium selected for the game array.

In some embodiments, the indicia set may include duplicate indicia. For example, an indicia set may comprise two standard card decks. In the case of slot-type games, indicia may be duplicated to allow winning game outcomes that require a predetermined minimum number of duplicate indicia to receive a specified award.

In addition, in some embodiments, a plurality of indicia sets may be available from which the player may select a replacement indicium. These indicia sets, in some embodiments, may be a subset of indicia with specific characteristics. For example, an indicia set of letters may be broken into two subsets; one subset comprising vowels and the other subset comprising consonants.

In other embodiments, the indicia set may include designated indicia that act as a "wild" indicia; entitling the player to use the "wild" indicia to represent any indicia. Typically, and in at least one embodiment, the gaming machine determines all of the indicia that the "wild" indicia may represent that provides a winning game outcome. Each of these winning game outcomes is credited to the player. For example, Jokers may be deemed to be wild cards and added to the indicia set. Alternatively, in another embodiment, certain indicia in the indicia set may be randomly selected as wild indicia.

The game array may have any number of individual games (i.e., primary games and secondary games) depending only on the size of the array. Pay lines may be used to facilitate player identification of primary and secondary games in the game array and are especially effective for identifying games with complex game geometry.

For example, in one embodiment, the indicia (or array positions) that comprise an individual game may be identified by a pay line that intersects each array position comprising the individual game. Exemplary game arrays are described below to contrast different array configurations and to demonstrate the inherent flexibility to design pay lines into game arrays to accommodate different types of games.

Figure 3:
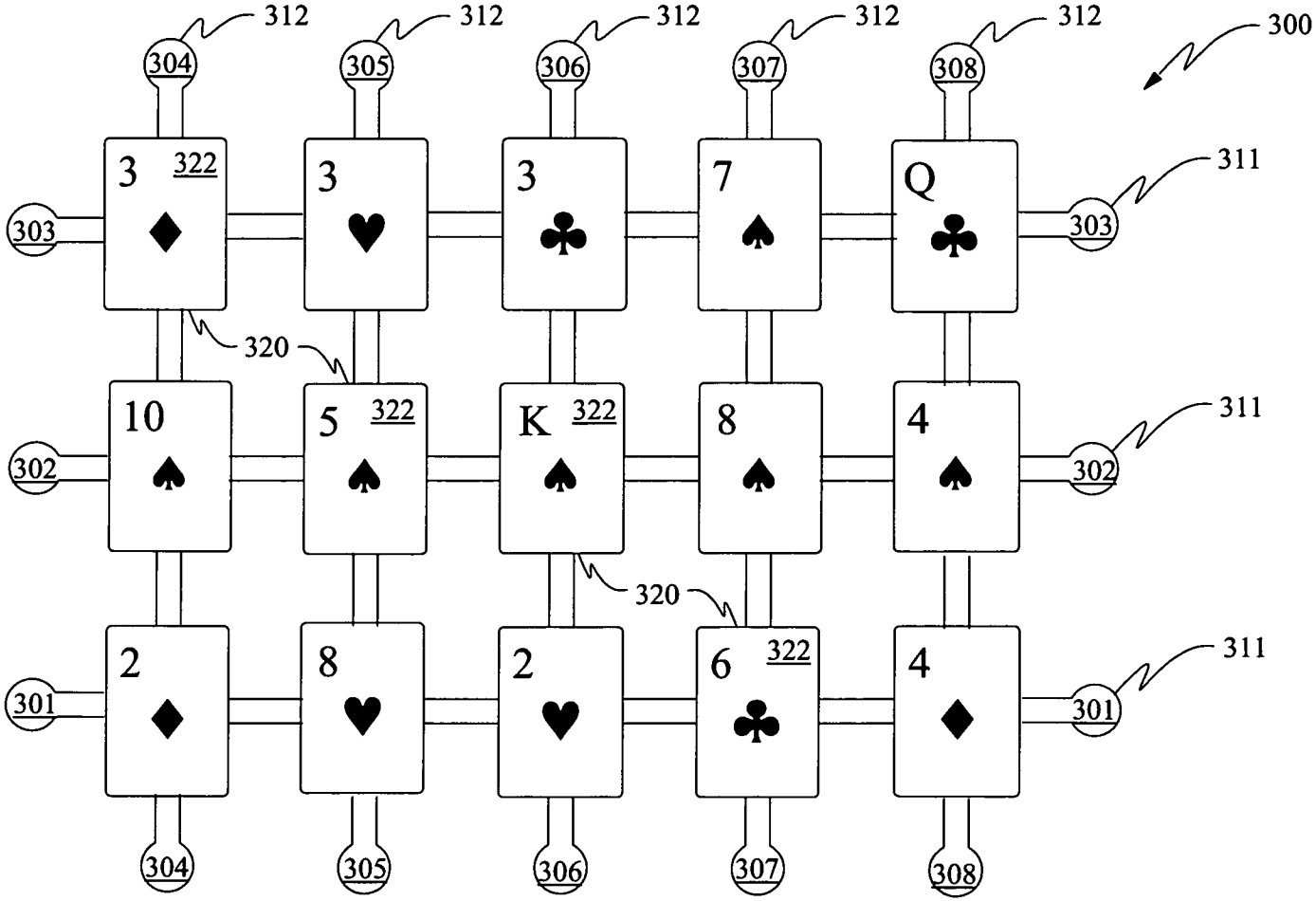
FIG. 3 illustrates an exemplary rectangular game array in one embodiment of the array game.

Referring to FIG. 3, an exemplary 3×5 rectangular game array 300 is illustrated having 15 array positions 320 with an indicium 322 in each array position. In this exemplary embodiment, the game array 300 is illustrated having three rows and five columns. Each row defining a primary game 311 depicted by pay lines 301, 302, and 303; and each column defining a secondary game 312 depicted by pay lines 304, 305, 306, 307, and 308.

In this embodiment, the primary games 311 are comprised of five indicia each and the secondary games 312 are comprised of three indicia each. The game array 300 illustrates how, in one embodiment, different combinations of array positions 320 from each of the primary games 311 may form secondary games 312. In this embodiment, each of the primary games 311 (depicted by pay lines 301, 302, and 303) contributes an indicium to each of the secondary games 312 (pay lines 304, 305, 306, 307, and 308). In this embodiment, each indicium from each of the primary games 311 is used in only one secondary game 312.

In the embodiment illustrated in FIG. 3, two different types of games may be played simultaneously in the array 300. For example, two different types of poker games may be played. The primary games 311 may be, for example, a standard five-card poker game. In contrast, the secondary games 312 may be a three-card poker game. Consequently, array 300 may have, in one embodiment, three five-card poker games and five three-card poker games.

The winning game outcomes for the five-card poker games and the three-card poker games illustrated in the game array 300 of FIG. 3 may be paid in accordance, in one embodiment, with predetermined pay tables. Referring to FIG. 4, an exemplary pay table 400 is illustrated for the five-card poker game. Winning game outcomes 410 are listed with their corresponding awards 420. Similarly, referring to FIG. 5, an exemplary pay table 500 is illustrated for the three-card poker game. Winning game outcomes 510 are listed with their corresponding awards 520.

The pay tables of FIG. 4 and FIG. 5 have the same winning game outcomes except that the pay table of FIG. 5 for the three-card poker game embodiment does not have the Full House and Four of a Kind winning game outcomes 410 available in the five-card poker game pay table of FIG. 5. Because the secondary games in the three-card poker game embodiment are limited to three indicia by array size and pay line geometry, the Full House and Four of a Kind winning game outcomes are not possible as they require at least five indicia and four indicia respectively.

Because the three-card and five-card poker games have different potential winning game outcomes, and further, because these winning game outcomes occur with different frequency between primary and secondary games, the payouts for each of the winning game outcomes in each of the two different games (i.e., primary and secondary games) may be different. This allows the pay table to pay larger awards for less probable winning game outcomes while maintaining a desired expected value for the game array as a whole.

As illustrated in FIG. 3, primary games depicted by pay lines 301, 302, and 303 all have winning game outcomes: a Pair, a Flush, and a Three of a Kind respectively in accordance with pay table 400 of FIG. 4 for a five-card poker game. It can also be seen that the player has won secondary games 307 and 308 with a Straight and a Pair respectively. Each of these winning secondary game outcomes is awarded in accordance with pay table 500 of FIG. 5 for a three-card poker game.

In the exemplary embodiment illustrated in FIG. 3, the player has wagered one credit on each of the 15 pay lines for a total of a 15 credit wager on the game array 300. The winning game outcomes in the game array 300 are awarded in accordance with the pay tables of FIG. 4 and FIG. 5 as follows: one credit for the Pair, four credits for the Flush, and two credits for the Three of a Kind in the primary games; and three credits for the Straight and one credit for the Pair in the secondary games. Consequently, the player is awarded a total of 1+4+2+3+1 credits or a total of 11 credits for the player's 15 credit bet.

The payback percentage is the average wager amount returned to a player averaged over many game outcomes. The payback percentage may vary among gaming establishments and among games. Some gaming establishments set payback percentages at approximately 90% to 95% for gaming machines. Some gaming establishments may even offer 100% payback percentages on some video poker gaming machines (the gaming establishment may assume that most players will not select optimum game play strategies).

In some embodiments, gaming machines are preprogrammed with two or three different payback percentages. The gaming establishment may then select the desired payback percentages for their particular needs and in accordance with jurisdictional rules of the local gaming authority.

Payback percentages are determined by both probability tables (mathematical probability of certain indicia combinations occurring during the game) and pay tables (payout values associated with winning game outcomes). Consequently, it is understood by those skilled in the art that the desired payback percentage can be achieved with appropriate adjustments to either or both the probability table and pay table of an array game as different games permit.

The probability table can be adjusted for some games, such as for slot-type games, to weigh certain game outcomes more heavily than others to achieve a desired payback percentage. In other games, such as poker-type games, the probability of occurrence of a specific game outcome is dictated by a standard 52 card deck. However, the probability of occurrence of certain game outcomes may also be adjusted by altering the game play mechanics to favor certain game outcomes.

For example, one game play mechanic that could be modified to achieve a desired payback percentage is to limit the number of indicia a player may discard. In one embodiment, there is no limit on the number of indicia (e.g., cards) that may be discarded and replaced. However, in other embodiments, there may be an upper limit placed on the number of discarded indicia, making a winning game outcome more challenging to obtain.

In another embodiment, game play mechanics can be altered with additional requirements such as, for example, replacing indicia or interchanging indicia contingent on qualifying requirements, such as holding at least a Jacks or Better Pair in a primary game.

Another example of altering game play mechanics is requiring eligibility requirements to be satisfied before awarding a winning game outcome. For example, in one embodiment, a winning game outcome may be required in a primary game in order to be eligible for an award in a secondary game.

The pay table itself may be adjusted to obtain a desired payback percentage by increasing or decreasing the payout associated with a winning game outcome. In a situation requiring a larger payback percentage, additional winning game outcomes may be created. In one embodiment, the pay table may provide an award to a player who acquires a specified number or type of winning game outcomes in the game array.

For example, the player may be awarded for collecting a Straight, a Flush, and a Three of a Kind in the game array. This is a particularly effective method for establishing the potential for providing an extremely large award to a player made financially possible as result of the low probability of occurrence.

Although the exemplary embodiments described above associate the primary games outcomes with the rows of the rectangular game array and the secondary game outcomes with the columns of the rectangular game array, in other embodiments, the position of the primary and secondary games may be reversed. For example, the columns of the rectangular game array may be primary games and the rows may be secondary games.

Figure 6A:
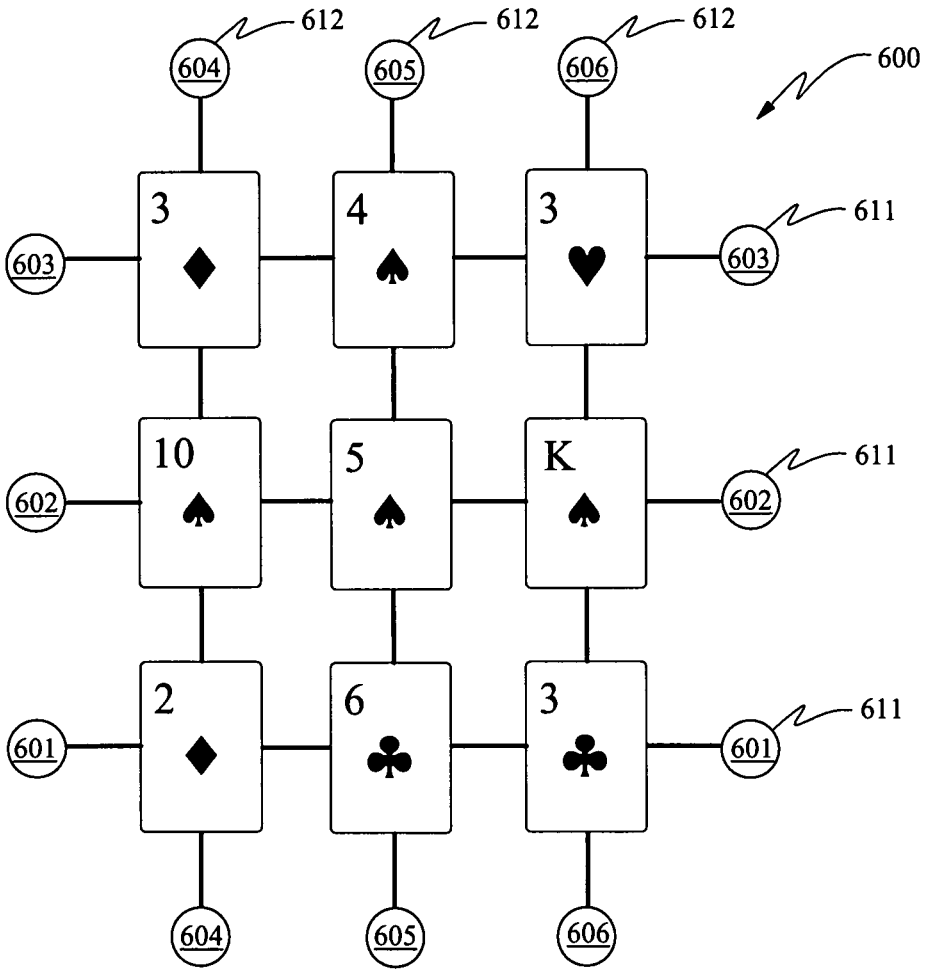
FIG. 6A illustrates an exemplary square game array in one embodiment of the array game.

Rectangular game arrays may, in some embodiments, be square arrays. With reference to FIG. 6A, a completed square array 600 is illustrated. This 3×3 array 600 has horizontal primary games 611 depicted by pay lines 601, 602, and 603; and vertical secondary games 612 depicted by pay lines 604, 605, and 606. By virtue of this array geometry and the pay lines as depicted, in one embodiment, the primary and secondary games may be identical. For example, the primary games 611 and secondary games 612 may both be a three-card poker game, or in another embodiment, both the primary and secondary games may be Black Jack games.

Although the 3×3 array 600 of FIG. 6A may have identical primary and secondary games, it does not preclude the 3×3 array from having different primary and secondary games.

For example, the primary games 611 may be a three-card poker game and the secondary games 612 may be Blackjack games.

If desired, the 3×3 array 600 may have more than the six total games (three primary games 611 and three secondary games 612). In the 3×3 array 600 illustrated in FIG. 6A, each indicium from a primary game 611 is used to form only one secondary game 612. However, if an indicium from a primary game 611 is used in more than one secondary game 612, additional secondary games may be formed.

Figure 6B:
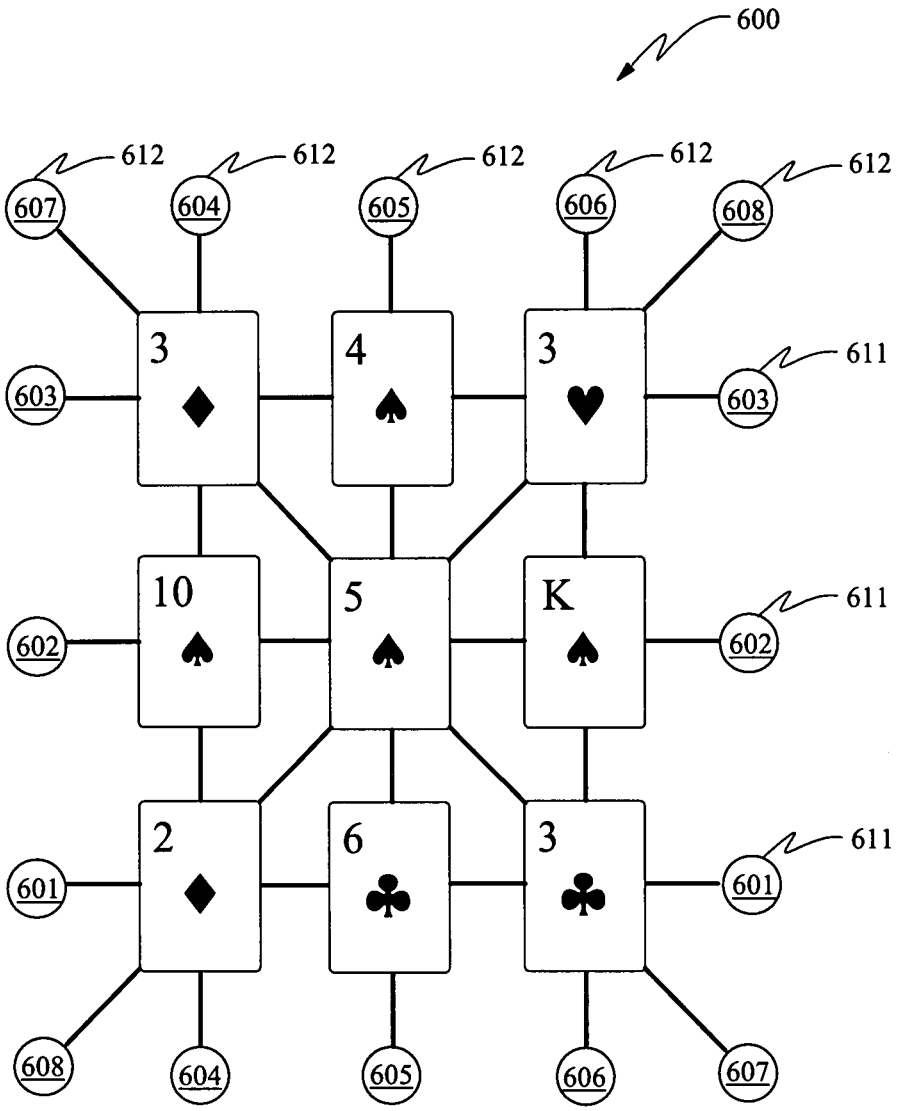
FIG. 6B illustrates the square game array of FIG. 6A with diagonal pay lines forming secondary games in another embodiment of the array game.

For example, with reference to FIG. 6B, the array 600 of FIG. 6A is illustrated with additional diagonal pay lines 607 and 608. The array 600 of FIG. 6B has a total of eight game outcomes: three primary games 611 depicted by horizontal pay lines 601, 602, and 603; three secondary games 612 depicted by vertical pay lines 604, 605, and 606; and two additional secondary games 612 depicted by diagonal pay lines 607 and 608. The secondary games 612 depicted by pay lines 607 and 608 allow the same indicium from a primary game outcome to be used in more than one secondary game outcome—increasing the total number of available game outcomes in a single game array.

Other predetermined array position combinations may be created to form additional secondary games. For example, with reference to FIG. 6C, the array 600 of FIG. 6A is illustrated with two new secondary games 612 depicted by pay lines 621 and 622. This illustrates, how in one embodiment, the use of a plurality of indicia from the same primary game 611 (in addition to at least one indicium from each of the remaining primary games) can create additional secondary games 612. Pay line 621 includes a total of five indicia: the Three of Diamonds, the Four of Spades, Three of Hearts, King of Spades, and Three of Clubs. Pay line 622 includes a total of five indicia: the Two of Diamonds, Six of Clubs, Five of Spades, Four of Spades, and Three of Hearts.

Figure 6C:
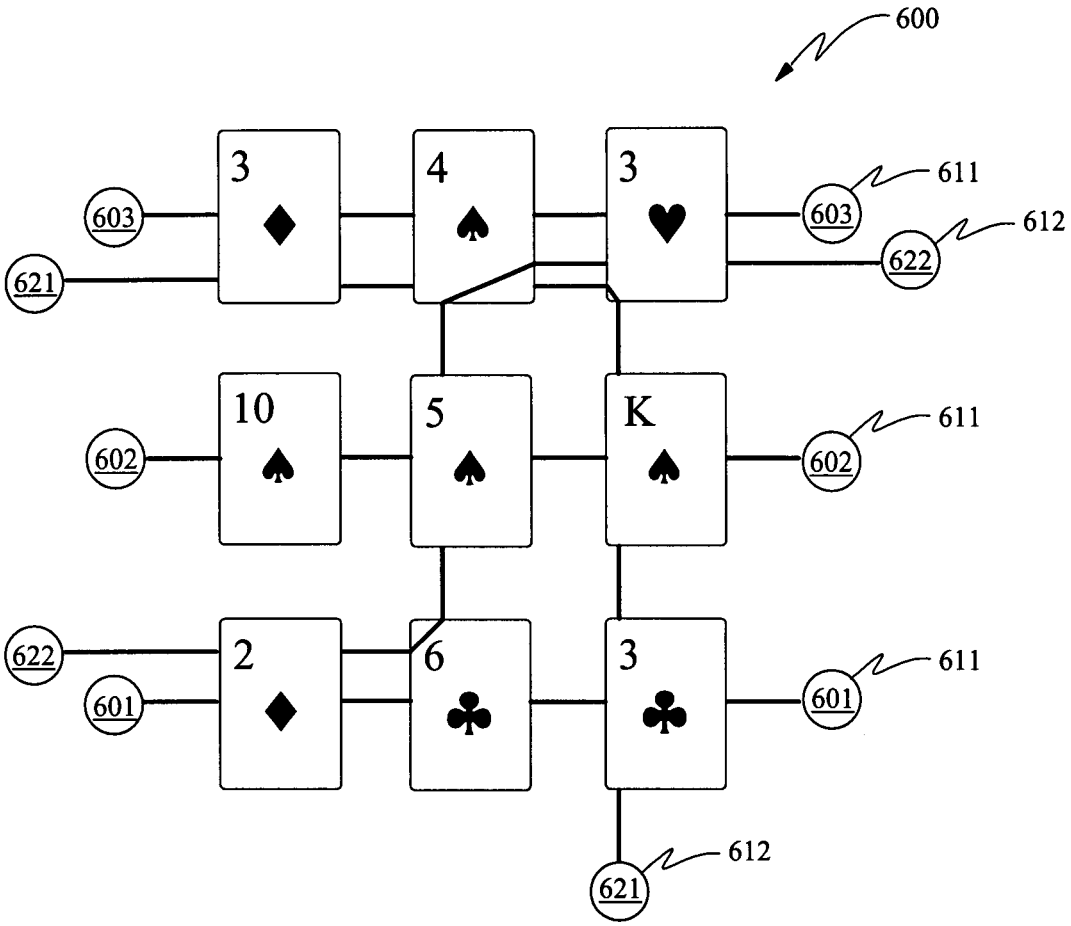
FIG. 6C illustrates the square game array of FIG. 6A having secondary games formed in which at least one of the primary games contributes a plurality of indicia to the secondary game in another embodiment of the array game.

In this embodiment, because the secondary games depicted by pay lines 621 and 622 have five indicia each, the 3×3 square array 600 of FIG. 6C could accommodate, for example, a five-card poker game in these secondary games. In addition, array 600 of FIG. 6C could also accommodate three-card poker games in its primary games 611, depicted by pay lines 601, 602, and 603, and secondary games 612 depicted by pay lines 604, 605, and 606 as discussed and illustrated by FIG. 6A.

In another embodiment, the secondary games may not have specific predetermined game array positions. Instead, winning secondary game outcomes may be defined as a plurality of indicia from a plurality of primary game outcomes that satisfy parameters related to their relative orientation in the array and that comprise a predetermined winning indicia combination.

For example, winning secondary game outcomes may be defined as a plurality of adjacent indicia (side to side adjacent and not diagonally adjacent) contributed from each primary game outcome that forms a winning indicia combination. Referring to FIG. 6C, pay lines 621 and 622 meet this winning game outcome requirement. Consequently, the secondary game pay lines could be: 1) predetermined based on specific array positions or 2) determined randomly as defined by a geometrical relationship of array positions having a combination of indicia that provides a winning game outcome.

Although only rectangular game arrays have been discussed, the progressively developed game array is not so limited: non-rectangular arrays may also be formed. For example, with reference to FIG. 7, a pyramidal shaped array 700 as illustrated.

A number of different types of primary games 711 and secondary games 712 may be implemented in pyramidal array 700. In this exemplary array, the primary game 711 depicted by pay line 701 is a seven-card poker game and forms the base of the pyramidal array 700. The primary game 711 depicted by pay line 702 is a five-card poker game forming the middle of the pyramidal array 700. The primary game 711 depicted by pay line 703 is a three-card poker game forming the top of the pyramidal array 700.

Figure 7:
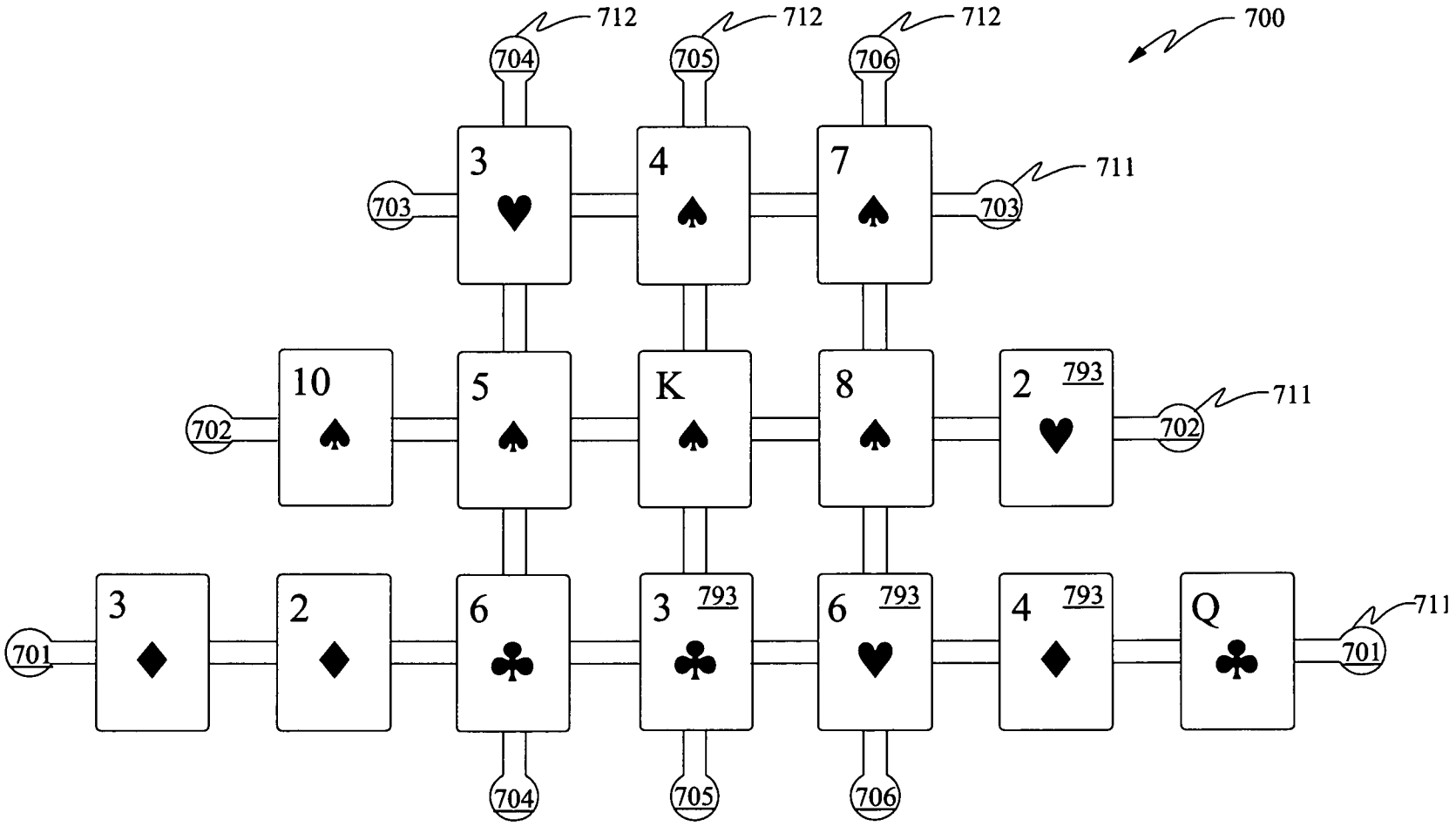
FIG. 7 illustrates an exemplary pyramidal game array in one embodiment of the array game.

The game array 700 in FIG. 7 illustrates that in some embodiments, not all the indicia in the primary games 711 are required to form secondary games 712. In addition, a variety of different primary games may be implemented in this game array by virtue of the different number of indicia in each of the primary games.

The primary games 711 in the pyramidal game array 700 of FIG. 7 form three secondary games 712 depicted by pay lines 704, 705, and 706. These three secondary games 712 each have three indicia 793 which may form, in a number of different embodiments, a variety of secondary games. The secondary games 712 may include for example, three-card poker or Blackjack games. In some embodiments, the secondary games 712 could include either three-card poker or blackjack games.

In still another embodiment, each of the secondary games 712 could act as dual games, i.e., each secondary game providing an award for satisfying either and/or both a winning game outcome under, for example, Blackjack or three-card poker rules. Essentially creating a "wild" game.

For example, secondary game depicted by pay line 706 has won two different awards for two different games: 1) a Straight has been created applying the rules for a three-card poker game; and 2) a perfect score of 21 applying the rules for a standard Black Jack game. Consequently, the player would be paid for both of these winning game outcomes obtained from a single primary game outcome.

The development of the game array from the serial determination of primary game outcomes has been described above. The discussion that follows amplifies on the application of operands to modify preliminary game outcomes in the primary games to determine final primary game outcomes.

Preliminary game outcomes, in one embodiment, result from the random selection and assignment of indicia to initialize each primary game in the array. A modification operation may be applied to these preliminary game outcomes to try to improve the probability of obtaining a winning game outcome in either or both the primary and secondary games. The modification operation, in one embodiment, is a predefined process for altering the game array according to specific procedural steps.

Any variety of rule-based modification operations could be employed to alter the preliminary game outcome. Modification operations, in some embodiments, may include any function that changes either one or more indicia in the array or the position of one or more indicia in the array.

Specific examples of modification operations include: 1) replacing at least one indicium with another randomly selected indicium (replacement modification operation), and 2) interchanging the array positions of indicia (interchange modification operation).

In some embodiments, modification operations may have restrictions that limit the applicability of the function in the array. For example, in one embodiment, the modification operations may be limited to the indicia in an active primary game (i.e., modifying a preliminary game outcome). Consequently, in this embodiment, the modification operation may not be applied to final primary game outcomes. In another embodiment, modification operations may only be allowed between a preliminary game outcome and primary game outcomes.

Modification operations involving the replacement of indicia in the array may impose a number of similar restrictions that limit the replacement modification operation. For example, in one embodiment, the replacement indicium may be selected from a subset of indicia from the indicia set, or may even be limited to a single replacement indicium.

In another embodiment, a modification operation may be selected from a plurality of modification operations. For example, in one embodiment, the player is given the option of holding the preliminary game outcome as a final game outcome or electing one or more modification operations (e.g., a replacement modification operation or an interchange modification operation).

In still another embodiment, different primary games in the array may have different selectable modification operations. For example, in one embodiment, in a 3×3 array with three primary games the player may elect to hold the preliminary game outcomes as final primary game outcomes or elect: 1) a replacement modification operation in the first primary game; 2) a replacement modification operation or an interchange modification operation in the second primary game; and 3) an interchange modification operation in the third primary game. Consequently, in this exemplary embodiment, each of the three primary games has a different set of selectable modification operations.

Allowing a choice between a plurality of modification operations provides the player an opportunity to implement a strategy because of the different affects each modification operation may have on the game array.

The modification operation selected has a significant effect on the probability of producing a winning game outcome and the volatility of the game. For example, in one embodiment, the strategy of interchanging indicia within a primary game does not affect the primary game outcome. However, interchanging indicia may have significant influence over the outcome in a secondary game. For example, interchanging indicia may not only lead to developing potential opportunities in one or more secondary games, it may in some cases produce a guaranteed winning game outcome.

There are, however, embodiments where interchanging indicia may produce winning game outcomes in a primary game. For example, in some embodiments, the order of indicia in the primary game (e.g., from left to right as distinguished by right to left along a pay line) may determine winning game outcomes or the value of winning game outcomes. Consequently, interchanging indicia in these embodiments may make the difference between a winning and losing game outcome in the primary game, and in some embodiments, in the secondary game as well.

In contrast, in one embodiment, the strategy of replacing indicia in a primary game with randomly selected indicia may improve the probability of a winning game outcome in both the primary and a secondary game—but at the risk of receiving replacement indicia that may decrease the probability of a winning game outcome.

The player may try to weigh the relative merits of an assured result from the interchange of indicia that increases the potential for a winning game outcome in secondary games against the probability of receiving a desired, but unpredictable replacement indicia to produce a winning game outcome in either or both a primary and secondary game. Consequently, the player may select modification operations based on the inherent volatility of the strategy produced by each modification operation.

For example, some players may want to implement a strategy that may result in a large payout, even though there is a low probability of success in lieu of selecting a modification operation that produces a guaranteed winning outcome of substantially smaller value.

Process Flow Diagrams

Figure 8:
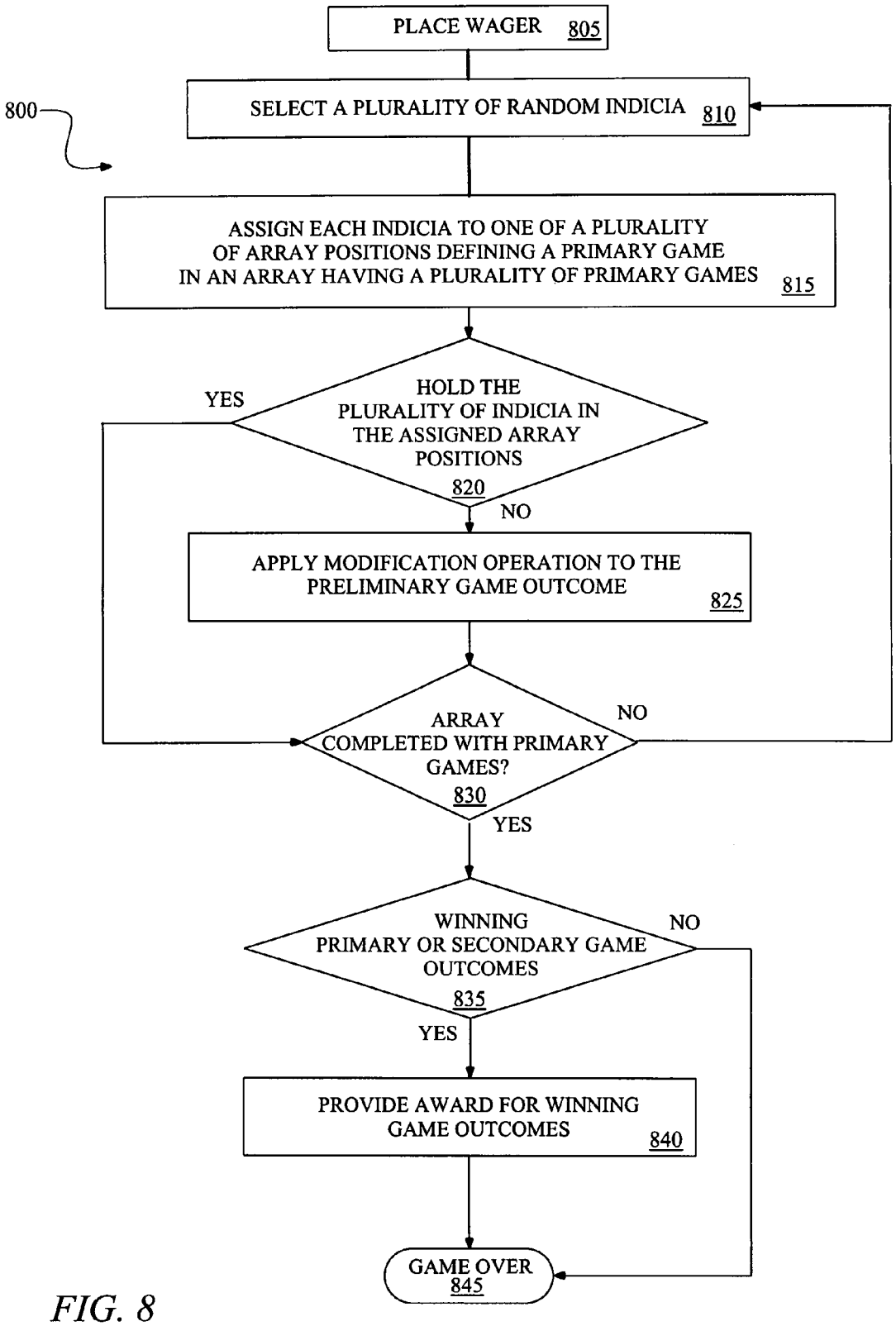
FIG. 8 is an exemplary process flowchart illustrating the wagering game with a single selectable modification operation in one embodiment of the array game.
Figure 9:
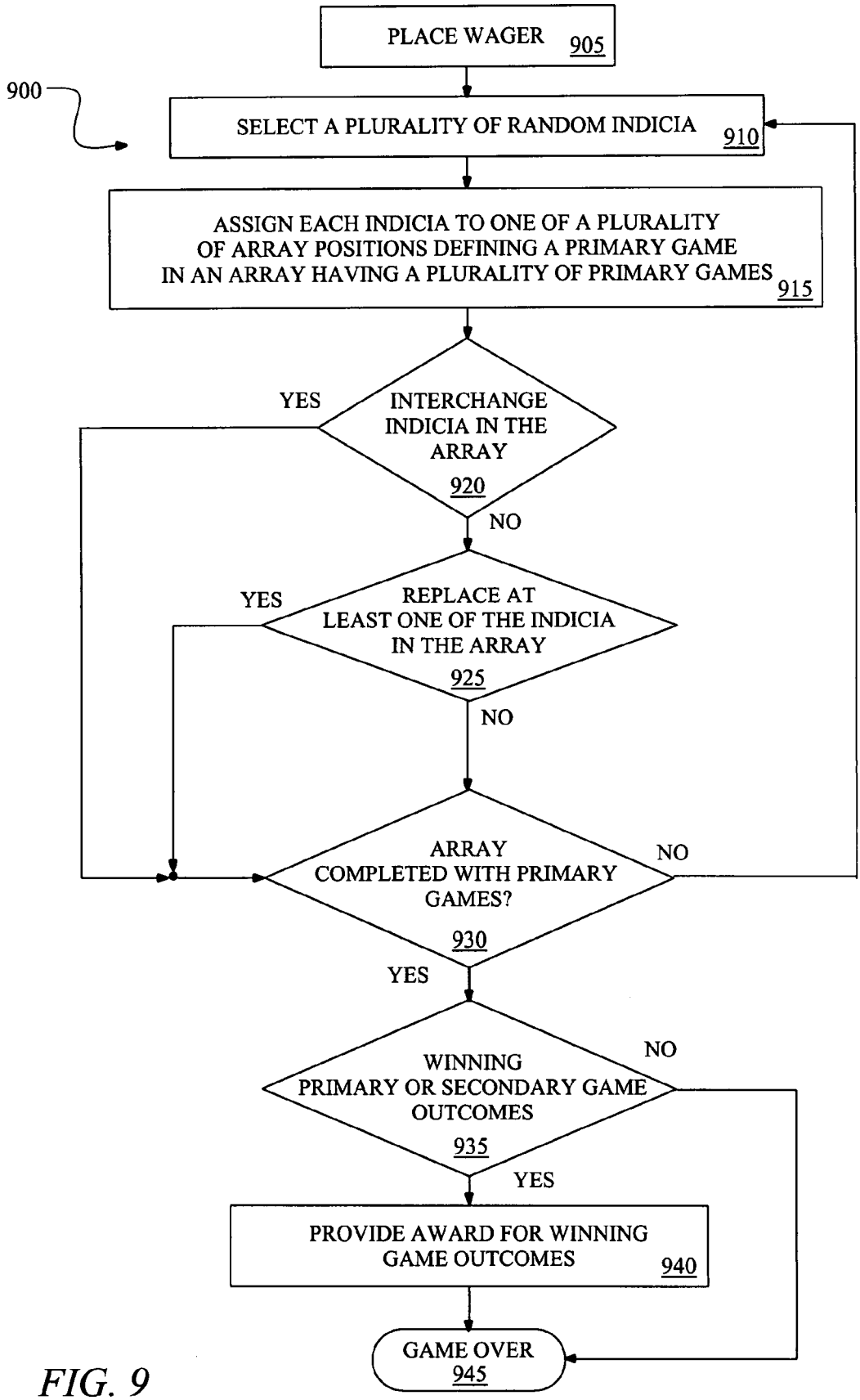
FIG. 9 is an exemplary process flowchart illustrating the wagering game with multiple selectable modification operations in one embodiment of the array game.

To provide further explanation of the modification operations in the context of game array development, exemplary process flowcharts are provided in FIG. 8 and FIG. 9 to illustrate the operation of the wagering game in two different embodiments. These process flowcharts are individually discussed as follows.

Single Selectable Modification Operation

Turning to FIG. 8, a wagering game process flowchart 800 illustrates one embodiment of the wagering process having a modification operation for modifying the game array. A wager is placed in step 805 to initiate the wagering game. A plurality of random indicia are selected in step 810. Each of the randomly selected indicia is assigned to an array position in the array defining a primary game in step 815. In step 820, the player may elect to hold the indicia as assigned in the primary game. If the player does not elect to hold the indicia as assigned, a modification operation is applied to the preliminary game outcome in step 825.

The modification operation in step 825 could be any modification operation. For example, the modification operation could be a replacement modification operation; allowing, in one embodiment, at least one of the indicia in a primary game to be replaced by another indicia randomly selected from an indicia set. Alternatively, in another embodiment, the modification operation of step 825 may be an interchange modification operation; switching the array positions of two indicia in the array.

Regardless of whether the player elects to hold the indicia as assigned to the preliminary game outcome or apply a modification operation to the game array, the array is checked to determine if all the primary games have been completed in step 830. If the primary games have not been completed, the process steps 810, 815, 820, 825, and 830 are repeated until all the primary game outcomes have been determined for the array. In this manner the array is progressively formed through the serial determination of each primary game outcome.

Once the array has been completed, the game array is evaluated to identify winning primary and secondary game outcomes in step 835. If a winning game outcome is identified, the appropriate award is provided in step 840 and the game ends in step 845.

Multiple Selectable Modification Operations

In other embodiments, the wagering game process may allow the selection of a modification operation from a plurality of modification operations (in contrast to the single modification operation available in the exemplary wagering game process illustrated in the FIG. 8). One embodiment of a wagering game allowing the selection of a modification operation from a plurality of modification operations is depicted in the exemplary wagering game process flowchart 900 illustrated in FIG. 9.

The wagering game process is initiated in step 905 with a wager. A plurality of random indicia is selected in step 910. In step 915, the randomly selected indicia are assigned to array positions defining a primary game. In step 920, the player may elect to interchange indicia in the array. If the player elects not to interchange indicia in step 920, the player may elect to replace indicia in the array in step 925. If the player elects not to interchange indicia or replace indicia, the indicia are held in the array as assigned.

In step 930 the array is evaluated to determine if the array has been completed with all the primary game outcomes. If the primary games have not been completed, the process described in steps 910, 915, 920, 925, and 930 are repeated until the array is completed. This process progressively builds the array as each primary game outcome is serially determined and added to the array.

Once the primary games are completed, any winning primary or secondary game outcomes are identified in step 935. Awards are provided for any winning game outcomes in step 940. After winning game outcomes have been awarded in step 940, or if no winning game outcomes are identified in step 935, the game is over at step 945.

With reference to FIGS. 10A through 10F, the progressive development of a game array in one embodiment of an exemplary wagering game is provided. This exemplary wagering game allows the player to select from a plurality of available modification operations to progressively develop a game array. As card type games are one of the most popular forms of gaming, and one of the most popular card games is poker, a three-card poker game is used to illustrate the specific game play mechanics of this exemplary embodiment. Other types of games, using single characteristic indicia could also be implemented as a variation of this embodiment In this exemplary embodiment, each of the primary and secondary games follows the general principles of three-card draw poker, i.e., the ability to either hold the card hand as dealt or discard cards and draw replacement cards. In addition, the player may elect to interchange indicia (i.e., cards) in a primary game to potentially build winning game outcomes in the secondary games.

The three-card poker pay table illustrated in FIG. 5 may be used as an exemplary pay table for this embodiment. This pay table shows the potential winning game outcomes 510 (card hands) and associated awards 520 for each winning game outcome (which are the same for both the primary and secondary games). FIG. 5 is only an exemplary pay table and any other suitable pay table may be used.

FIG. 10A through 10F illustrates the development of a 3×3 array having six games—three primary games (the rows of the array) and three secondary games (the columns of the array). In this embodiment, each of the primary games is serially developed by assigning randomly selected indicia from an indicia set 1099 into predetermined array positions defining a primary game. This produces a preliminary game outcome. The preliminary game outcome may be modified with a modification operation or the indicia may be held as initially assigned to their array positions.

In one embodiment, a primary game outcome to the preliminary game outcome is determined before the next preliminary game outcome in the series of primary games is determined. Consequently, the array is formed in stages, each stage marked by the completion of one of the primary games in the series of primary games. The number of primary games in the series is the number of primary games in the array. Consequently, the completion of all of the primary game outcomes in the series has been completed, the array is completed.

The secondary games are progressively developed as the primary games are completed. The array is completed with the determination of the third primary game outcome. Consequently, the game embodiment development illustrated in FIG. 10A through FIG. 10F generally follows the wagering game flow process illustrated in FIG. 9.

Figure 10A:
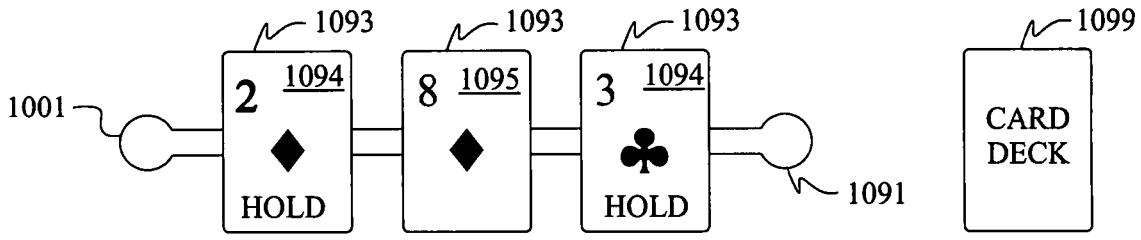
FIG. 10A is an exemplary first preliminary game outcome illustrating a first embodiment of the array game.

With reference to FIG. 10A, a three-card preliminary game outcome 1091 is illustrated for the primary game indicated by pay line 1001. The preliminary game outcome 1091 is formed from three preliminary game indicia 1093 randomly selected from indicia set 1099 (e.g., a card deck).

In this embodiment, as noted above, the player is allowed to either hold the randomly selected preliminary game indicia 1093 in their assigned array positions, interchange indicia in the preliminary game outcome 1091, or discard and receive replacement indicia 1096 from the indicia set 1099. In the first primary game depicted by pay line 1001, there is no strategic value—in this embodiment—to interchanging any of the indicia in the first preliminary game outcome.

In this case, the player elects to replace indicia and designates the Two of Diamonds and Three of Clubs as held indicia 1094, making the Eight of Diamonds the only discarded indicia 1095. The player's strategy is to win the primary game indicated by pay line 1001 with a Straight by drawing either a Four or Ace of any suit randomly from the indicia set 1099.

Figure 10B:
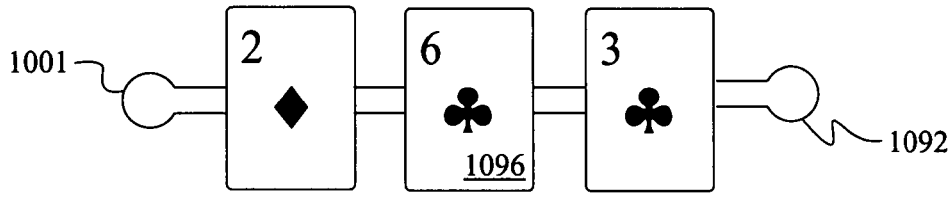
FIG. 10B is an exemplary first primary game outcome of the preliminary game outcome of FIG. 10A.

Referring to FIG. 10B, the primary game outcome 1092 resulting from discarding the Eight of Diamonds and receiving in its place the Six of Clubs as a replacement indicium 1096 is illustrated. Consequently, the player has failed to draw a Straight or any other winning game outcome in this primary game depicted by pay line 1001.

In this embodiment, the discarded indicium 1095 (in this case, the Eight of Diamonds) is reintroduced into the indicia set 1099. Consequently, the discarded indicium 1095 could potentially be selected again from the indicia set 1099 as a replacement indicium 1096 or as a randomly selected preliminary game indicium 1093 in subsequent primary games. Alternatively, in some other embodiments, the discarded indicia 1095 may not be available in subsequent primary games as either a preliminary game indicium 1093 or as a replacement indicium 1096.

Figure 10C:
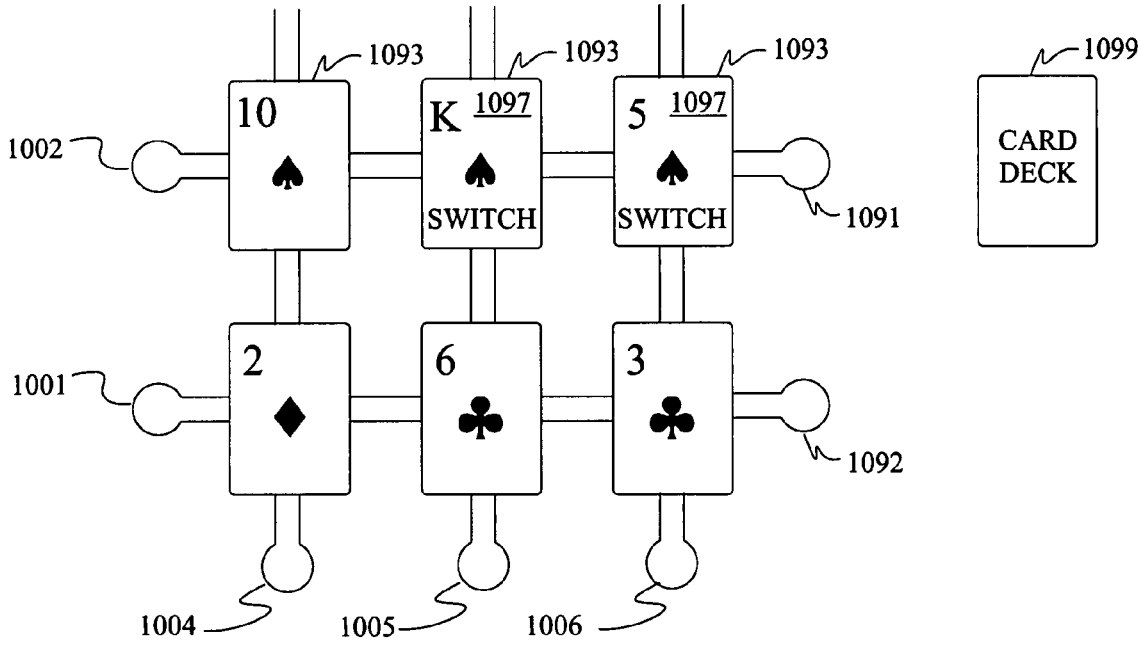
FIG. 10C depicts the progressive development of the game array of FIG. 10B with the addition of an exemplary second preliminary game outcome to the game array.

Referring to FIG. 10C, a second preliminary game outcome 1091 for a second primary game indicated by pay line 1002 is populated with preliminary game indicia 1093 randomly selected indicia from the indicia set 1099. These preliminary game indicia 1093 are aligned over each of the indicia from the first primary game indicated by pay line 1001. This is the next step in the progressive development of the 3×3 square game array.

As can be seen from FIG. 10C, the player has received a Flush (i.e., three Spades) in the preliminary game outcome 1091 of the second primary game indicated by pay line 1002. The player has an opportunity to potentially create a Straight in the secondary game indicated by pay line 1005 by designating the Five of Spades and King of Spades as interchanging indicia 1097.

Figure 10D:
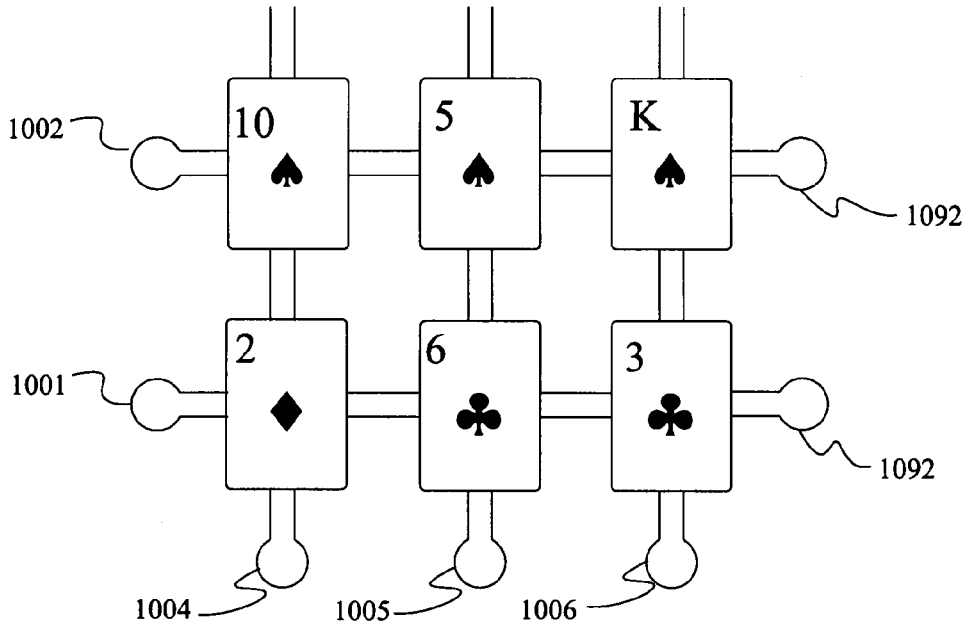
FIG. 10D is an exemplary second primary game outcome of the second preliminary game outcome of FIG. 10C.

As illustrated with reference to FIG. 10D, the interchange of the indicia has occurred. The implementation of this strategy maintains the player's winning game outcome (i.e., Flush) received in the preliminary game outcome 1091 (which becomes the primary game outcome) indicated by pay line 1002 while attempting to potentially receive a Straight in the secondary game indicated by pay line 1005.

Figure 10E:
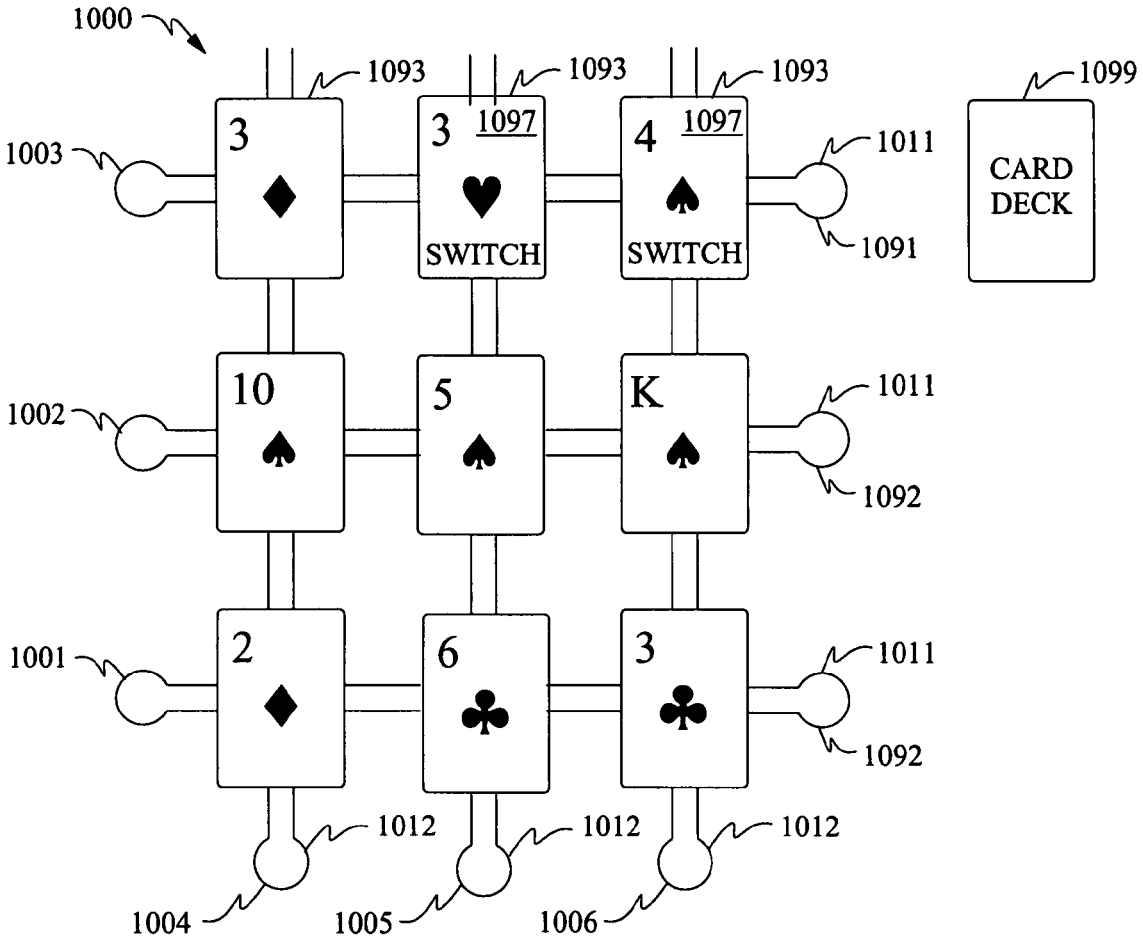
FIG. 10E depicts the progressive development of the game array of FIG. 10D with the addition of a third exemplary preliminary game outcome to the game array.

As shown in FIG. 10E, a third preliminary game 1091 for the primary game indicated by pay line 1003 is populated with preliminary game indicia 1093 randomly selected from indicia set 1099. The preliminary game indicia 1093 are aligned in array positions over the indicia from the first and second primary games indicated by pay lines 1001 and 1002 respectively.

Based on the preliminary game indicia 1093 in the third primary game indicated by pay line 1003, the player could attempt to complete a Three of a Kind—discarding the Four of Spades with the possibility of receiving a Three of any suit as a replacement indicium 1096. However, by observation, the Three of Clubs is already in the first primary game indicated by pay line 1001, leaving only one chance from the indicia set 1099 (which started the array game with a standard 52 card deck) to obtain the Three of Spades (the only Three card left in the indicia set 1099). Except for the preliminary game indicia 1093 forming a pair of threes, no other significant potential winning outcome appears in the third primary game indicated by pay line 1003. An inspection of the secondary games indicated by pay lines 1005 and 1006 shows that by switching the Four of Spades with the Three Of Hearts in the third primary game indicated by pay line 1003, a winning game outcome can be obtained in these two secondary games; a Straight in the secondary game indicated by pay line 1005 and a Pair in the secondary game indicated by pay line 1006. In addition, the winning game outcome (i.e., a Pair) in the primary game indicated by pay line 1003 can be maintained. The player selects the Four of Spades and the Three of Hearts as interchange indicia 1097. The interchange is performed and the game outcome of the 3×3 array 1000 is illustrated in FIG. 10F.

Figure 10F:
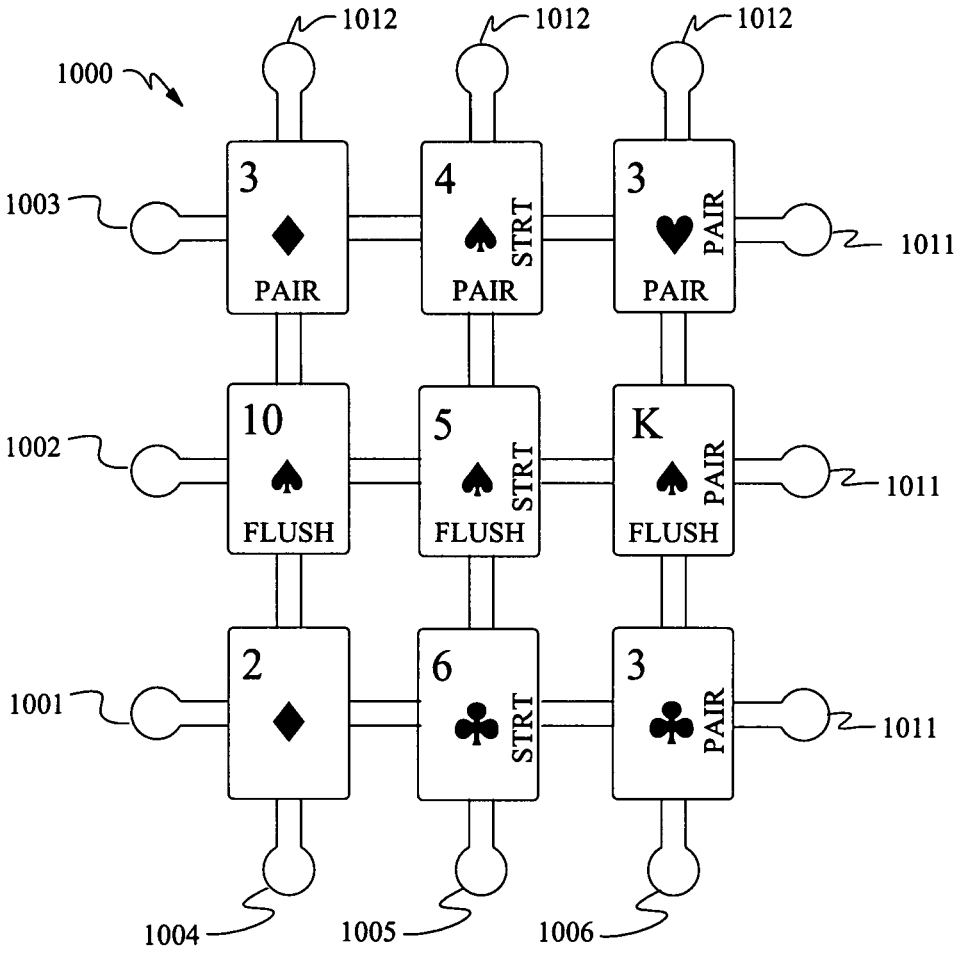
FIG. 10F is an exemplary third primary game outcome of the third preliminary game outcome of FIG. 10E.

With reference to FIG. 10F, by inspection, the winning game outcomes in the game array 1000 are: 1) a Flush (Spades) in primary game 1011 indicated by pay line 1002; 2) a Pair (Three of Diamonds And Three of Hearts) in primary game 1011 indicated by pay line 1003; 3) a Straight (Four of Spades, Five of Spades, and Six of Clubs) in the secondary game 1012 indicated by pay line 1005; and 4) a Pair (Three of Hearts and Three of Clubs) in the secondary game 1012 indicated by pay line 1006.

Using the exemplary pay table of FIG. 5, the player of the above poker game with the outcomes illustrated in FIG. 10F would receive 7 credits for a one credit bet on each of the six games in the array 1000 (i.e., one credit for the Pair of Threes in the primary game, two credits for the Flush, a three credits for the Straight and one credit for the Pair of Threes in the secondary game).

With reference to FIGS. 11A through 11E, the sequential development of the game array of another wagering game embodiment is illustrated. Similarly to the embodiment of FIGS. 10A through 10F, the embodiment illustrated in FIGS. 11A through 11F allows a player to either hold indicia from the preliminary game outcome, interchange indicia, or replace indicia. In this embodiment, however, in lieu of discarding and receiving an unknown replacement indicium 1196, a replacement indicium is displayed for identification by the player for possible use prior to the player's election to hold or modify the preliminary game outcome. In this embodiment, the known replacement indicium 1196 is selected randomly from the indicia set 1199 for each of the primary games. Furthermore, in the embodiment illustrated in FIG. 11A through 11E, the player is limited to only one replacement indicium 1196 for each of the primary games.

Figure 11A:
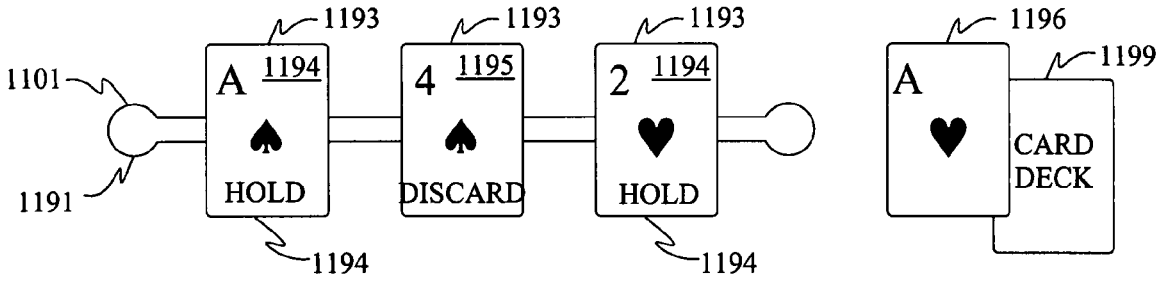
FIG. 11A is an exemplary first preliminary game outcome illustrating a second embodiment of the array game.

For example, with reference to FIG. 11A, the preliminary game outcome 1191 for the first primary game indicated by pay line 1101 displays a potential replacement indicium 1196 (the Ace of Hearts) randomly selected from the indicia set 1199. In this case, the player elects to replace the Four of Spades with the Ace of Hearts by designating the Ace of Spades and the Two of Hearts as held indicia 1194 leaving the Four of Spades as a discarded indicium 1195.

Figure 11B:
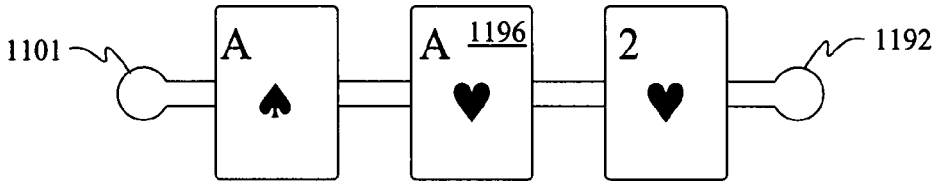
FIG. 11B is an exemplary first primary game outcome of the preliminary game outcome of FIG. 11A.

Referring to FIG. 11B, the replacement of the Four of Spades with the replacement indicium 1196 (Ace of Hearts) is illustrated. This provides the player with a Pair of Aces for primary game outcome 1192 indicated by pay line 1101.

Figure 11C:
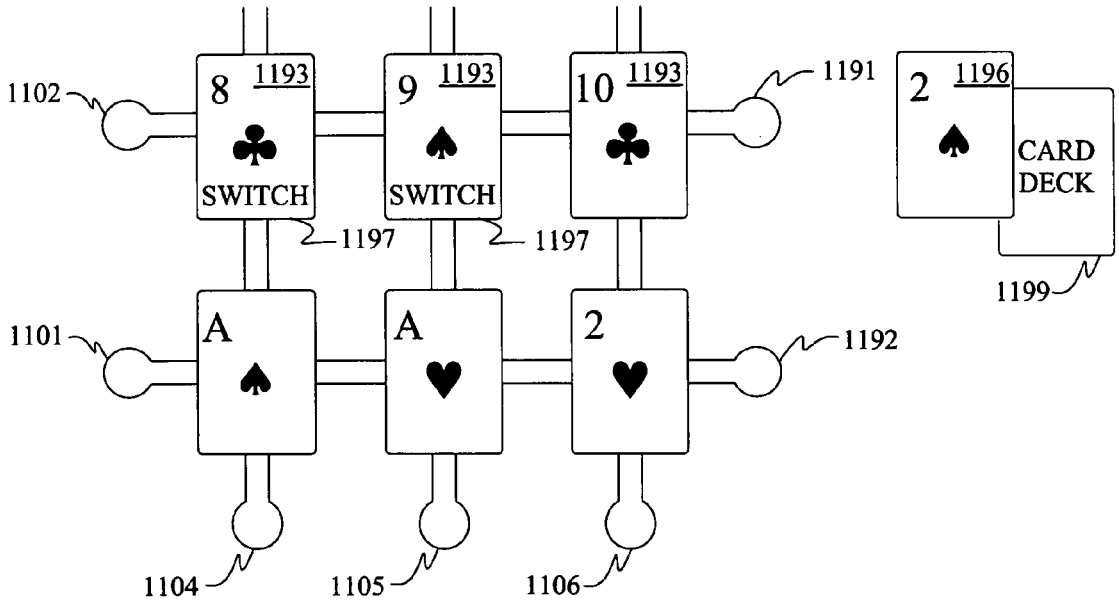
FIG. 11C depicts the progressive development of the game array of FIG. 11B with the addition of a second exemplary preliminary game outcome to the game array.

Referring to FIG. 11C, a second preliminary game outcome 1191 indicated by pay line 1102 is dealt immediately above the first primary game indicated by pay line 1101 to progressively build a rectangular array. A Straight is dealt in the preliminary game outcome 1191 in the second primary game indicated by pay line 1102. The Two of Spades is a potential replacement indicium 1196 selected randomly from the indicia set 1199. This replacement indicium 1196 is not helpful as it would not produce, in any combination with the preliminary game indicia 1193 in preliminary game outcome 1191 indicated by pay line 1102, a winning primary game outcome. In fact, the Two of Spades as a replacement indicium 1196 would only eliminate the existing Straight found in the preliminary game outcome 1191 indicated by pay line 1102.

Furthermore, only a Pair may be created in the secondary game indicated by pay line 1106 if the replacement indicium 1196 (i.e., Two of Spades) is used to replace the Ten of Clubs. Alternatively, the replacement indicium 1196 (i.e., Two of Spades) could replace the Eight of Clubs providing the potential for creating a straight flush in the secondary game indicated by pay line 1104. This move, however, eliminating the already present Straight in the preliminary game outcome 1191 indicated by pay line 1102. Fortunately, a superior strategic move is available.

Figure 11D:
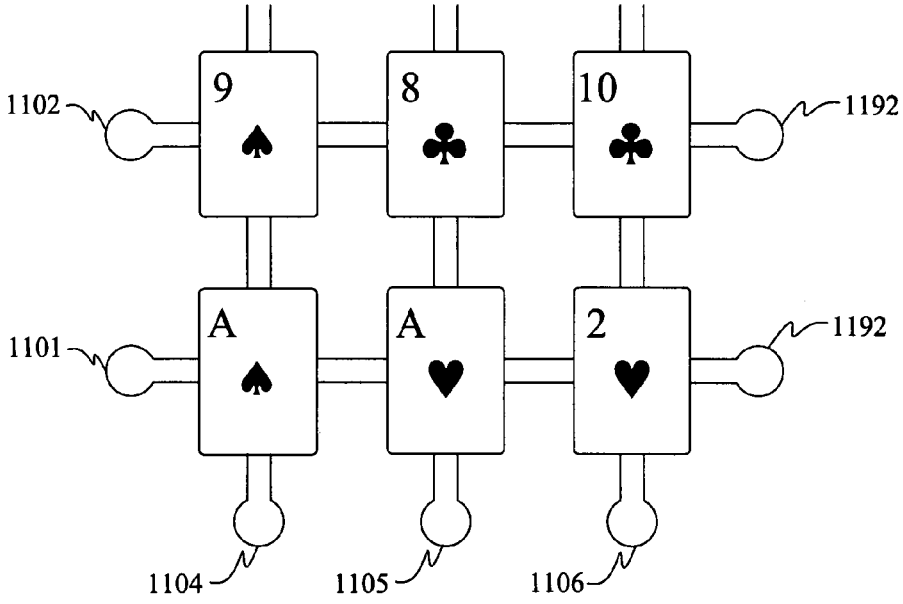
FIG. 11D is an exemplary second primary game outcome of the second preliminary game outcome of FIG. 11C.

The Eight of Clubs and the Nine of Spades can be switched (i.e., interchanged) to increase the likelihood of obtaining a Flush in the secondary game indicated by pay line 1104. The election to make this interchange has been selected as illustrated in FIG. 11D.

Figure 11E:
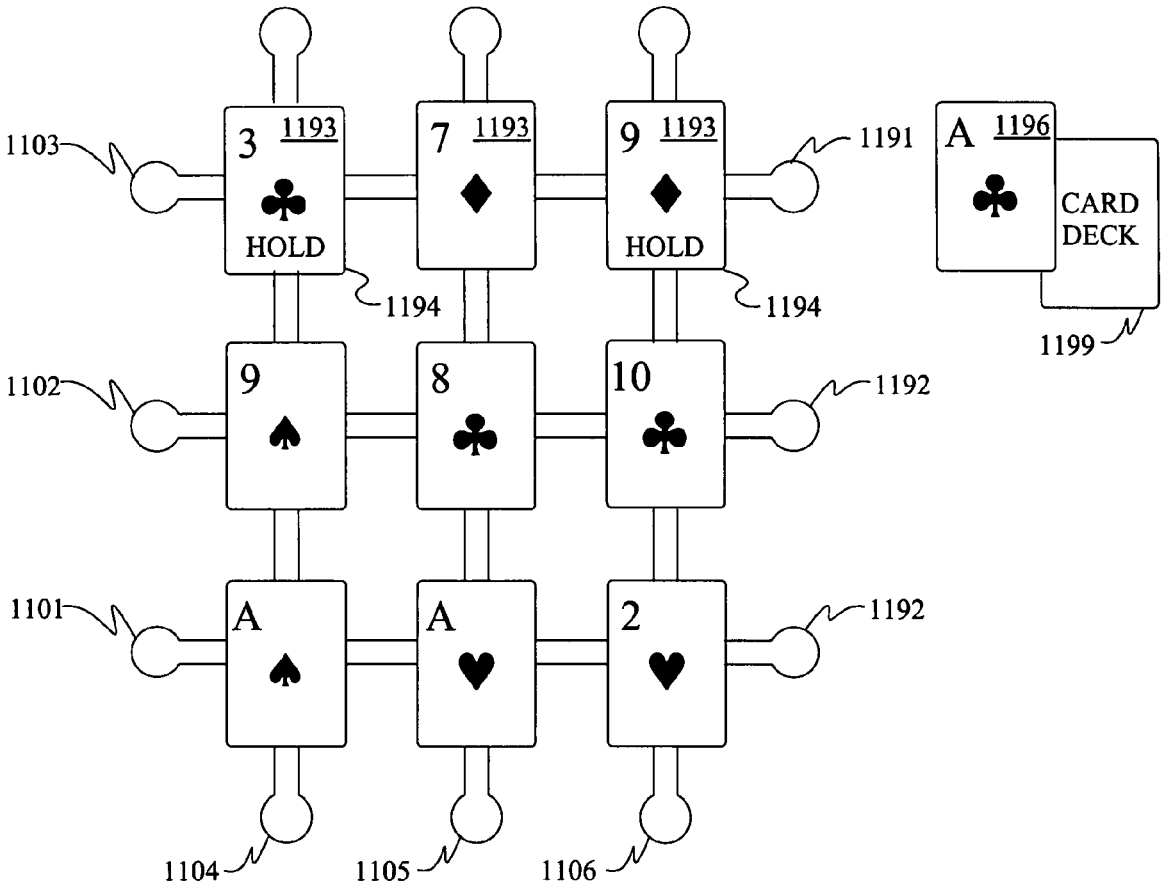
FIG. 11E depicts the progressive development of the game array of FIG. 11D with the addition of a third exemplary preliminary game outcome to the game array.

With respect to FIG. 11E, a preliminary game outcome 1191 is illustrated for the primary game indicated by pay line 1103. The potential replacement indicium 1196 is the Ace of Clubs randomly selected from the indicia set 1199. The Ace of Clubs can be used to replace the Seven of Diamonds to obtain a Pair (Aces) in the secondary game indicated by pay line 1105. Alternatively, the Ace of Clubs can be used to replace the Three of Clubs to obtain a Pair (Aces) in the secondary game indicated by pay line 1104. As there is no advantage over the other, the Seven of Diamonds is replaced with the Ace of Clubs.

Figure 11F:
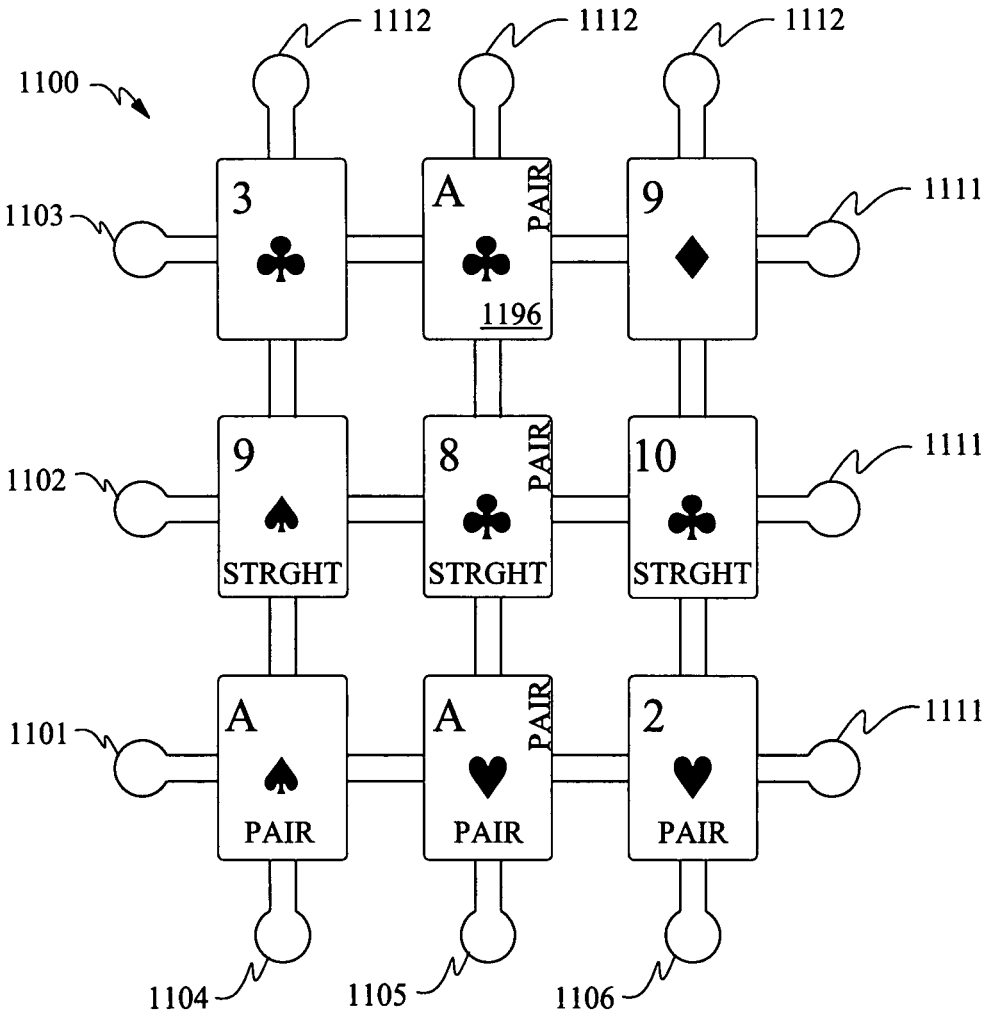
FIG. 11F is an exemplary third primary game outcome of the third preliminary outcome game of FIG. 11E.

Completion of the third primary game indicated by pay line 1103 completes the 3×3 game array 1100 as shown in FIG. 11F. By inspection of FIG. 11F, game array 1100 contains the following winning game combinations: 1) a Pair of Aces in the primary game indicated by pay line 1101; 2) a Straight (Nine of Spades, Eight of Clubs, and Ten of Clubs) in the primary game indicated by pay line 1102; and 2) a Pair of Aces in secondary game indicated by pay line 1105.

Using the three-card poker game pay table of FIG. 5, the payout for this game array 1100 can be determined assuming the player has wagered one credit on each of the six games (three primary games and three secondary games). Referring to the pay table of FIG. 5, the player receives three credits for the Straight and one credit for each of the Pair of Aces. Consequently, the player, in this example, receives a total of five credits back from the initial wager of six credits on the 3×3 array game.

In a variation of the exemplary embodiment illustrated in FIG. 11A through FIG. 11F, a plurality of potential replacement indicia 1196 (e.g., cards) may be randomly selected and displayed for player identification from an indicia set 1199 (e.g., card deck). A player may select any one (or in some variations, a plurality) of the indicia as replacement indicia 1196 for any of the preliminary game indicia 1193 in a currently played primary game. In another variation of this embodiment, a new set of potential replacement indicia 1196 may be selected randomly for each subsequent primary game from the indicia set 1199.

While the invention has been illustrated with respect to several specific embodiments, these embodiments are illustrative rather than limiting. Various modifications and additions could be made to each of these embodiments as will be apparent to those skilled in the art. Accordingly, the invention should not be limited by the above description or of the specific embodiments provided as examples. Rather, the invention should be defined only by the following claims.

The invention claimed is:

1. A method of playing a wagering game with a gaming machine, comprising the steps of:

accepting a wager with a wager acceptor to initiate the wagering game;

forming an array with a series of sequentially determined primary game outcomes with a processor, the array having a plurality of array positions aligned to form a plurality of rows and a plurality of columns in the array, wherein each of the rows of the array is one of the primary game outcomes, further wherein determining each one of the primary game outcomes in the series comprises:

assigning an indicium randomly selected from an indicia set to each of the plurality of array positions in one of the plurality of rows;

receiving a player selection which identifies at least one of the plurality of array positions in the one of the plurality of rows corresponding to the one of the primary game outcomes being determined; and in response to the player selection, replacing the indicium in each of the at least one of the plurality of array positions identified with another indicium randomly selected from the indicia set;

wherein each one of the primary game outcomes is determined before the next one of the primary game outcomes in the series is initiated, and further wherein the primary game outcomes form a secondary game outcome in at least one of the plurality of columns of the array;

presenting the wagering game on a video display; and providing an award for a winning game outcome with a payout mechanism.

2. A method of playing a wagering game on a gaming machine, comprising the steps of:

accepting a wager with a wager acceptor to initiate the wagering game;

forming an array with a series of sequentially determined primary game outcomes with a processor, the array having a plurality of array positions aligned to form a plurality of rows and a plurality of columns in the array, wherein each of the rows of the array is one of the primary game outcomes, wherein determining each one of the primary game outcomes in the series comprises:

assigning an indicium randomly selected from an indicia set to each of the plurality of array positions in one of the plurality of rows;

receiving a player selection; and in the one of the plurality of rows corresponding to the one of the primary game outcomes being determined, in accordance with the player selection, one of either:

holding the indicium assigned to each of the plurality of array positions; or replacing the indicium assigned to at least one of the plurality of array positions with another indicium randomly selected from the indicia set;

wherein each one of the primary game outcomes is determined before the next one of the primary game outcomes in the series is initiated, further wherein the primary game outcomes form a secondary game outcome in at least one of the plurality of columns of the array;

presenting the wagering game on a video display; and providing an award for a winning game outcome with a payout mechanism.

3. A gaming machine comprising:

a wager acceptor for initiating a wagering game;

a video display for displaying the wagering game;

a player input device for receiving a player selection;

a processor for sequentially forming a series of primary game outcomes in an array, the array having a plurality of array positions aligned to form a plurality of rows and a plurality of columns, wherein each of the rows of the array is one of the primary game outcomes, and further wherein each one of the primary game outcomes in the series is determined with the processor configured to:

assign a randomly selected indicium from an indicia set to each one of the plurality of array positions in one of the plurality of rows of the array; and replace, in response to the player selection, the indicium assigned to at least one of the plurality of array positions in the one of the plurality of rows corresponding to the one of the primary game outcomes being determined with another indicium randomly selected from the indicia set;

wherein each one of the primary game outcomes is determined before the next one in the series of primary game outcomes is initiated, and further wherein the series of primary game outcomes form a secondary game outcome in at least one of the plurality of columns of the array; and a payout mechanism for providing an award for a winning game outcome;

wherein the processor executes a game program to control the wager acceptor, the payout mechanism, and the video display, and further wherein the processor is in communication with the player input device.

* * * * *